US008635077B2

(12) United States Patent
Nakamura et al.

(10) Patent No.: US 8,635,077 B2
(45) Date of Patent: Jan. 21, 2014

(54) APPARATUS AND METHOD FOR EXPANDING/COMPRESSING AUDIO SIGNAL

(75) Inventors: Osamu Nakamura, Saitama (JP); Mototsugu Abe, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1206 days.

(21) Appl. No.: 11/875,346

(22) Filed: Oct. 19, 2007

(65) Prior Publication Data

US 2008/0097752 A1 Apr. 24, 2008

(30) Foreign Application Priority Data

Oct. 23, 2006 (JP) ..... 2006-287905

(51) Int. Cl.
*G10L 21/04* (2013.01)

(52) U.S. Cl.
USPC ..... 704/503

(58) Field of Classification Search
USPC ..... 704/503
See application file for complete search history.

(56) References Cited

U.S. PATENT DOCUMENTS

| | | | | |
|---|---|---|---|---|
| 5,647,005 | A * | 7/1997 | Wang et al. | 381/62 |
| 6,678,650 | B2 | 1/2004 | Inoue | |
| 6,801,898 | B1 * | 10/2004 | Koezuka | 704/500 |
| 6,990,195 | B1 * | 1/2006 | LeBlanc et al. | 379/406.08 |
| 2004/0125003 | A1 * | 7/2004 | Craven et al. | 341/76 |
| 2005/0240962 | A1 * | 10/2005 | Cooper et al. | 725/38 |
| 2006/0235680 | A1 * | 10/2006 | Yamamoto et al. | 704/206 |
| 2007/0137464 | A1 * | 6/2007 | Moulios et al. | 84/612 |
| 2010/0042407 | A1 * | 2/2010 | Crockett | 704/200.1 |
| 2011/0103466 | A1 * | 5/2011 | Hanna | 375/240.02 |

FOREIGN PATENT DOCUMENTS

| | | |
|---|---|---|
| JP | 11-289599 | 10/1999 |
| JP | 2001-255894 | 9/2001 |
| JP | 2002-297200 | 10/2002 |
| JP | 2003-345397 | 12/2003 |
| JP | 2006-293230 | 10/2006 |
| JP | 2007-163915 | 6/2007 |

OTHER PUBLICATIONS

Diana Deutsch, Music Recognition 1969, Psychological Review, pp. 1-7.*

Morita and Itakura, The Journal of Acoustical Society of Japan, Oct. 1986, p. 149-150.

Notification of Reasons for Rejection, issued by the Japanese Patent Office, dated Jun. 8, 2011, in a Japanese application No. 2006-287905 (3 pages).

Armani and Omologo, "Weighted Autocorrelation-Based F0 Estimation for Distant-Talking Interaction with a Distributed Microphone Network," ICASSP 2004, I-113-I-116.

* cited by examiner

*Primary Examiner* — Jakieda Jackson
(74) *Attorney, Agent, or Firm* — Finnegan, Henderson, Farabow, Garrett & Dunner, L.L.P.

(57) ABSTRACT

In an audio signal expanding/compressing apparatus adapted to expand or compress, in a time domain, a plurality of channels of audio signals by using similar waveforms, a similar-waveform length detection unit calculates similarity of the audio signal between two successive intervals for each channel, and detects a similar-waveform length of the two intervals on the basis of the similarity of each channel.

17 Claims, 38 Drawing Sheets

ORIGINAL WAVEFORM

EXPANDED WAVEFORM

EXPANSION FORM

ORIGINAL WAVEFORM

EXPANDED WAVEFORM

EXPANSION FORM

ORIGINAL WAVEFORM

FADE-OUT WAVE FORM

FADE-IN WAVEFORM

EXPANDED WAVEFORM

ORIGINAL WAVEFORM

EXPANDED WAVEFORM

ORIGINAL WAVEFORM

FADE-OUT WAVE FORM

FADE-IN WAVEFORM

COMPRESSED WAVEFORM

ORIGINAL WAVEFORM

COMPRESSED WAVEFORM

APPARATUS AND METHOD FOR EXPANDING/COMPRESSING AUDIO SIGNAL

CROSS REFERENCES TO RELATED APPLICATIONS

The present invention contains subject matter related to Japanese Patent Application JP 2006-287905 filed in the Japanese Patent Office on Oct. 23, 2006, the entire contents of which are incorporated herein by reference.

BACKGROUND OF THE INVENTION

1. Field of the Invention

The present invention relates to an audio signal expansion/compression apparatus and an audio signal expansion/compression method for changing a playback speed of an audio signal such as a music signal.

2. Description of the Related Art

PICOLA (Pointer Interval Control OverLap and Add) is known as one of algorithms of expanding/compressing a digital audio signal in a time domain (see, for example, "Expansion and compression of audio signals using a pointer interval control overlap and add (PICOLA) algorithm and evaluation thereof", Morita and Itakura, The Journal of Acoustical Society of Japan, October, 1986, p. 149-150). An advantage of this algorithm is that the algorithm needs a simple process and can provide good sound quality for a processed audio signal. The PICOLA algorithm is briefly described below with reference to some figures. In the following description, signals such as a music signal other than voice signals are referred to as acoustic signals, and voice signals and acoustic signals are generically referred to as audio signals.

FIGS. 22A to 22D illustrate an example of a process of expanding an original waveform using the PICOLA algorithm. First, intervals having a similar waveform in an original signal (FIG. 22A) are detected. In the example shown in FIG. 22A, intervals A and B similar to each other are detected. Note that intervals A and B are selected so that they include the same number of samples. Next, a fade-out waveform (FIG. 22B) is produced from the waveform in the interval B, and a fade-in waveform (FIG. 22C) is produced from the waveform in the interval A. Finally, an expanded waveform (FIG. 22D) is produced by connecting the fade-out waveform (FIG. 22B) and the fade-in waveform (FIG. 22C) such that the fade-out part and the fade-in part overlap with each other. The connection of the fade-out waveform and the fade-in waveform in this manner is called cross fading. Hereafter, the cross-faded interval between the interval A and the interval B is denoted by A×B. As a result of the process described above, the original waveform (FIG. 22A) including the intervals A and 3 is converted into the expanded waveform (FIG. 22D) including the intervals A, A×B, and B.

FIGS. 23A to 23C illustrate a manner of detecting the interval length W of the intervals A and B which are similar in waveform to each other. First, intervals A and B starting from a start point P0 and including j samples are extracted from an original signal as shown in FIG. 23A and evaluated. The similarity in waveform between the intervals A and B is evaluated while increasing the number of sample j as shown in FIGS. 23A, 23B, and 23C, until highest similarity is detected between the intervals A and B each including j samples. The similarity may be defined, for example, by the following function D(j).

$$D(j)=(1/j)\Sigma\{x(i)-y(i)\}^2(i=0 \text{ to } j-1) \quad (1)$$

where x(i) is the value of an i-th sample in the interval A, and y(i) is the value of an i-th sample in the interval B. D(j) is calculated for j in the range WMIN≤j≤WMAX, and j is determined which results in a minimum value for D(j). The value of j determined in this manner gives the interval length W of intervals A and B having highest similarity. WMAX and WMIN are set in the range of, for example, 50 to 250. When the sampling frequency is 8 kHz, WMAX and WMIN are set, for example, such as WMAX=160 and WMIN=32. In the present example, D(j) has a lowest value in the state shown in FIG. 23B, and j in this state is employed as the value indicating the length of the highest-similarity interval.

Use of the function D(j) described above is important in the determination of the length W of an interval with a similar waveform (hereinafter, referred to simply as a similar-interval length W). This function is used only in finding intervals similar in waveform to each other, that is, this function is used only in a pre-process to determine a cross-fade interval. The function D(j) is applicable even to a waveform having no pitch such as white noise.

FIGS. 24A and 24B illustrate an example of a manner in which a waveform is expanded to an arbitrary length. First, j is determined for which the function D(j) has a minimum value with respect to a start point P0, and W is set to j (W=j) as described above with reference to FIGS. 23A to 23C. Next, an interval 2401 is copied as an interval 2403, and a cross-fade waveform between the intervals 2401 and 2402 is produced as an interval 2404. An intervals obtained by removing the interval 2401 from the total interval from P0 to P0' in the original waveform shown in FIG. 24A is copied at a position directly following the cross-fade interval 2404 as shown in FIG. 24B. As a result, the original waveform including L samples in the range from the start point P0 to the point P0' is expanded to a waveform including (W+L) samples. Hereinafter, the ratio of the number of samples included in the expanded waveform to the number of samples included in the original waveform will be denoted by r. That is, r is given the following equation.

$$r=(W+L)/L(1.0<r\leq 2.0) \quad (2)$$

Equation (2) can be rewritten as follows.

$$L=W\cdot 1/(r-1) \quad (3)$$

To expand the original waveform (FIG. 24A) by a factor of r, the point P0' is selected according to equation (4) shown blow.

$$P0'=P0+L \quad (4)$$

If R is defined by 1/r as equation (5), then L is given by equation (6) shown below.

$$R=1/r(0.5\leq R<1.0) \quad (5)$$

$$L=W\cdot R/(1-R) \quad (6)$$

By introducing the parameter R as described above, it becomes possible to express the playback length such that "the waveform is played back for a period R times longer than the period of the original waveform" (FIG. 24A). Hereinafter, the parameter R will be referred to as a speech speed conversion ratio. When the process for the range from the point P0 to the point P0' in the original waveform (FIG. 24A) is completed, the process described above is repeated by selecting the point P0' as a new start point P1. In the example shown in FIGS. 24A and 24B, the number of samples L is equal to about 2.5 W, the signal is played back at a speed about 0.7 times the original speed. That is, in this case, the signal is played back at a speed slower than the original speed.

Next, a process of compressing an original waveform is described. FIGS. 25A to 25D illustrate an example of a manner in which an original waveform is compressed using the PICOLA algorithm. First, intervals having a similar waveform in an original signal (FIG. 25A) are detected. In the example shown in FIG. 25A, intervals A and B similar to each other are detected. Note that intervals A and B are selected so that they include the same number of samples. Next, a fade-out waveform (FIG. 25B) is produced from the waveform in the interval A, and a fade-in waveform (FIG. 25C) is produced from the waveform in the interval B. Finally, a compressed waveform (FIG. 25D) is produced by superimposing the fade-in waveform (FIG. 25C) on the fade-out waveform (FIG. 25B). As a result of the process described above, the original waveform (FIG. 25A) including the intervals A and B is converted into the compressed waveform (FIG. 25D) including the cross-fade interval A×B.

FIGS. 26A and 26B illustrate an example of a manner in which a waveform is compressed to an arbitrary length. First, j is determined for which the function D(j) has a minimum value with respect to a start point P0, and W is set to j (W=j) as described above with reference to FIGS. 23A to 23C. Next, a cross-fade waveform between the intervals 2601 and 2602 is produced as an interval 2603. An interval obtained by removing the intervals 2601 and 2602 from the total interval from P0 to P0' in the original waveform shown in FIG. 26A is copied in a compressed waveform (FIG. 26B). As a result, the original waveform including (W+L) samples in the range from the start point P0 to the point P0' (FIG. 26A) is compressed to a waveform including L samples (FIG. 26B). Thus, the ratio of the number of samples of compressed waveform to the number of samples of original waveform is given by r as described below.

$$r=L/(W+L)(0.5<r1.0) \tag{7}$$

Equation (7) can be rewritten as follows.

$$L=W\cdot r/(1-r) \tag{8}$$

To compress the original waveform (FIG. 26A) by a factor of r, the point P0' is selected according to equation (9) shown blow.

$$P0'=P0+(W+L) \tag{9}$$

If R is defined by 1/r as equation (10), then L is given by equation (11) shown below.

$$R=1/r(1.0\leq R<2.0) \tag{10}$$

$$L=W\cdot 1/(R-1) \tag{11}$$

By defining the parameter R as described above, it becomes possible to express the playback length such that "the waveform is played back for a period R times longer than the period of the original waveform (FIG. 26A). When the process for the range from the point P0 to the point P0' in the original waveform (FIG. 26A), the process described above is repeated by selecting the point P0' as a new start point P1. In the example shown in FIGS. 26A and 26B, the number of samples L is equal to about 1.5 W, the signal is played back at a speed about 1.7 times the original speed. That is, in this case, the signal is played back at a speed faster than the original speed.

Referring to a flow chart shown in FIG. 27, the waveform expanding process according to the PICOLA algorithm is described in further detail below. In step S1001, it is determined whether there is an audio signal to be processed in an input buffer. If there is no audio signal to be processed, the process is ended. If there is an audio signal to be processed, the process proceeds to step S1002. In step S1002, j is determined for which the function D(j) has a minimum value with respect to a start point P, and W is set to j (W=j). In step S1003, L is determined from the speech speed conversion ratio R specified by a user. In step S1004, an audio signal in an interval A including W samples in a range starting from a start point P is output to an output buffer. In step S1005, a cross-fade interval C is produced from the interval A including W samples starting from the start point P and a next interval B including W samples. In step S1006, data in the produced interval C is supplied to the output buffer. In step S1007, data including (L−W) samples in a range staring from a point P+W is output from the input buffer to the output buffer. In step S1008, the start point P is moved to P+L. Thereafter, the processing flow returns to step S1001 to repeat the process described above from step S1001.

Next, referring to a flow chart shown in FIG. 28, the waveform compression process according to the PICOLA is described in further detail below. In step S1101, it is determined whether there is an audio signal to be processed in an input buffer. If there is no audio signal to be processed, the process is ended. If there is an audio signal to be processed, the process proceeds to step S1102. In step S1102, j is determined for which the function D(j) has a minimum value with respect to a start point P, and W is set to j (W=j). In step S1103, L is determined from the speech speed conversion ratio R specified by a user. In step S1104, a cross-fade interval C is produced from the interval A including W samples starting from the start point P and a next interval B including W samples. In step S1105, data in the produced interval C is supplied to the output buffer. In step S1106, data including (L−W) samples in a range staring from a point P+2W is output from the input buffer to the output buffer. In step S1107, the start point P is moved to P+(W+L). Thereafter, the processing flow returns to step S1101 to repeat the process described above from step S1101.

FIG. 29 illustrates an example of a configuration of a speech speed conversion apparatus 100 using the PICOLA algorithm. First, an audio signal to be processed is stored in an input buffer 101. A similar-waveform length detector 102 examines the audio signal stored in the input buffer 101 to detect j for which the function D(j) has a minimum value, and sets W to j (W=j). The similar-waveform length W determined by the similar-waveform length detector 102 is supplied to the input buffer 101 so that the similar-waveform length W is used in a buffering operation. The input buffer 101 supplies 2W samples of audio signal to a connection waveform generator 103. The connection waveform generator 103 compresses the received 2W samples of audio signal into W samples by performing cross-fading. In accordance with the speech speed conversion ratio R, the input buffer 101 and the connection waveform generator 103 supplies audio signals to the output buffer 104. An audio signal is generated by the output buffer 104 from the received audio signals and output, as an output audio signal, from the speech speed conversion apparatus 100.

FIG. 30 is a flow chart illustrating the process performed by the similar-waveform length detector 102 configured as shown in FIG. 29. In step S1201, an index j is set to an initial value of WMIN. In step S1202, a subroutine shown in FIG. 31 is executed to calculate a function D(j), for example, given by equation (12) shown below.

$$D(j)=(1/j)\Sigma\{f(i)-f(j+i)\}^2(i=0 \text{ to } j-1) \tag{12}$$

where f is the input audio signal. In the example shown in FIG. 23A, samples starting from the start point P0 are given as the audio signal f. Note that equation (12) is equivalent to equation (1). In the following discussion, the function D(j) expressed in the form of equation (12) will be used. In step S1203, the value of the function D(j) determined by executing the subroutine is substituted into a variable MIN, and the index j is substituted into W. In step S1204, the index j is incremented by 1. In step S1205, a determination is made as to whether the index j is equal to or smaller than WMAX. If the index j is equal to or smaller than WMAX, the process proceeds to step S1206. However, if the index j is greater than WMAX, the process is ended. The value of the variable W obtained at the end of the process indicates the index j for which the function D(j) has a minimum value, that is, this value gives the similar-waveform length, and the variable MIN in this state indicates the minimum value of the function D(j). In step S1206, the subroutine shown in FIG. 31 is executed to determine the value of the function D(j) for a new index j. In step S1207, it is determined whether the value of the function D(j) determined in step S1206 is equal to or smaller than MIN. If so the process proceeds to step S1208, but otherwise the process returns to step S1204. In step S1208, the value of the function D(j) determined by executing the subroutine is substituted into the variable MIN, and the index j is substituted into W.

The subroutine shown in FIG. 31 is executed as follows. In step S1301, the index i and a variable s are reset to 0. In step S1302, it is determined whether the index i is smaller than the index j. If so, the process proceeds to step S1303, but otherwise the process proceeds to step S1305. In step S1303, the square of the difference between the magnitude of the audio signal for i and that for j+i, and the result is added to the variable s. In step S1304, the index i is incremented by 1, and the process returns to step S1302. In step S1305, the variable s is divided by j, and the result is set as the value of the function D(j), and the subroutine is ended.

The manner of performing the speech speed conversion on a monaural signal using the PICOLA algorithm has been described above. For a stereo signal, the speech speed conversion according to the PICOLA algorithm is performed, for example, as follows.

FIG. 32 illustrates an example of a functional block configuration for the speech speed conversion using the PICOLA algorithm. In FIG. 32, an L-channel audio signal is denoted simply as L, and an R-channel audio signal is denoted simply by R. In the example shown in FIG. 32, the process is performed simply as the same manner as that to shown in FIG. 29, independently for the L-channel and the R-channel. This method is simple, but is not widely used in practical applications because the speech speed conversion performed independently for the R channel and the L channel can result in a slight difference in synchronization between the R channel and the L channel, which makes it difficult to achieve precise localization of the sound. If the location of the sound fluctuates, a user will have a very uncomfortable feeling.

In a case where two speakers are placed at right and left locations to reproduce a stereo signal, a listener feels as if a reproduced sound comes from an area in the middle between the right and left speakers. In some cases, the apparent location of a sound source sensed by a listener moves between the two speakers. However, in most cases, the audio signal is produced so that the apparent location of a sound source is fixed in the middle between the two speakers. However, even if a slight difference in temporal phase between right and left channels occurs as a result of the speech speed conversion, the difference causes the location of the sound, which should be in the middle of the two speakers, to fluctuate between the right and left speakers. Such a fluctuation in the sound location causes a listener to have a very uncomfortable. Therefore, in the speech speed conversion for a stereo signal, it is very important not to create a difference in synchronization between right and left channels.

FIG. 33 illustrates an example of a speech speed conversion apparatus configured to perform the speech speed conversion on a stereo signal without creating a difference in synchronization between right and left channels (see, for example, Japanese Unexamined Patent Application Publication No. 2001-255894). When an input audio signal to be processed is given, a left-channel signal is stored in an input buffer 301, and a right-channel signal is stored in an input buffer 305. A similar-waveform length detector 302 detects a similar-waveform length W for the audio signals stored in the input buffer 301 and the input buffer 305. More specifically, the average of the L-channel audio signal stored in the input buffer 301 and the R-channel audio signal stored in the input buffer 305 is determined by an adder 309, thereby converting the stereo signal into a monaural signal. The similar-waveform length W is determined for this monaural signal by detecting j for which the function D(j) has a minimum value, and W is set to j (W=j). The similar-waveform length W determined for the monaural signal is used as the similar-waveform length W in common for the R-channel audio signal and the L-channel audio signal. The similar-waveform length W determined by the similar-waveform length detector 302 is supplied to the input buffer 301 of the L channel and the input buffer 305 of the R channel so that the similar-waveform length W is used in a buffering operation.

The L-channel input buffer 301 supplies 2W samples of L-channel audio signal to a connection waveform generator 303. The R-channel input buffer 305 supplies 2W samples of R-channel audio signal to a connection waveform generator 307.

The connection waveform generator 303 converts the received 2W samples of L-channel audio signal into W samples of audio signal by performing the cross-fading process. The connection waveform generator 307 converts the received 2W samples of R-channel audio signal into W samples of audio signal by performing the cross-fading process.

The audio signal stored in the L-channel input buffer 301 and the audio signal produced by the connection waveform generator 303 are supplied to an output buffer 304 in accordance with a speech speed conversion ratio R. The audio signal stored in the R-channel input buffer 305 and the audio signal produced by the connection waveform generator 307 are supplied to an output buffer 308 in accordance with the speech speed conversion ratio R. The output buffer 304 combines the received audio signals thereby producing an L-channel audio signal, and the output buffer 308 combines the received audio signals thereby producing an R-channel audio signal. The resultant R and L-channel audio signals are output from the speech speed conversion apparatus 300.

FIG. 34 is a flow chart illustrating a processing flow associated with the process performed by the similar-waveform length detector 302 and the adder 309. The process shown in FIG. 34 is similar to that shown in FIG. 31 except that the function D(j) indicating the measure of similarity between two waveforms is calculated differently. In FIG. 34 and in the following description, fL denotes a sample value of an L-channel audio signal, and fR denotes a sample value of an R-channel audio signal.

The subroutine shown in FIG. 34 is executed as follows. In step S1401, the index i and a variable s are reset to 0. In step S1402, it is determined whether the index i is smaller than the index j. If so the process proceeds to step S1403, but otherwise the process proceeds to step S1405. In step S1403, the stereo signal is converted into a monaural signal and the square of the difference of the difference of the monaural signal is determined, and the result is added to the variable s.

More specifically, the average value a of an i-th sample value of the L-channel audio signal and an i-th sample value of the R-channel audio signal is determined. Similarly, the average value b of a (i+j)th sample value of the R-channel audio signal and an (i+j)th sample value of the L-channel audio signal is determined. These average values an and b respectively indicate i-th and (i+j)th monaural signals converted from the stereo signals. Thereafter, the square of the difference between the average value a and the average value b, and the result is added to the variable s. In step S1404, the index i is incremented by 1, and the process returns to step S1402. In step S1405, the variable s is divided by the index j, and the result is set as the value of the function D(j). The subroutine is then ended.

FIG. 35 illustrates a configuration of a speech speed conversion apparatus disclosed in Japanese Unexamined Patent Application Publication No. 2002-297200. This configuration is similar to that shown in FIG. 33 in that the speech speed conversion is performed without creating a difference in synchronization between R and L channels, but different in that a different input signal is used in detection of the similar-waveform length. More specifically, in the configuration shown in FIG. 35, unlike the configuration shown in FIG. 33 in which the monaural signal is produced by calculating the average between R and L-channel audio signals, energy of each frame is determined for each of R and L channels, and a channel with greater energy is used as a monaural signal.

In the configuration shown in FIG. 35, when an audio signal to be processed is input, a left-channel signal is stored in an input buffer 401, and a right-channel signal is stored in an input buffer 405. A similar-waveform length detector 402 detects a similar-waveform length W for the audio signal stored in the input buffer 401 or the input buffer 405 corresponding to a channel selected by the channel selector 409. More specifically, the channel selector 409 determines energy of each frame of the L-channel audio signal stored in the input buffer 401 and that of the R-channel audio signal stored in the input buffer 405, and the channel selector 409 selects an audio signal with greater energy thereby converting the stereo signal into the monaural audio signal. For this monaural audio signal, the similar-waveform length detector 402 determines the similar-waveform length W by detecting j for which the function D(j) has a minimum value, and sets W to j (W=j). The similar-waveform length W determined for the channel having greater energy is used in common as the similar-waveform length W for the R-channel audio signal and the L-channel audio signal. The similar-waveform length W determined by the similar-waveform length detector 402 is supplied to the input buffer 401 of the L channel and the input buffer 405 of the R channel so that the similar-waveform length W is used in a buffering operation. The L-channel input buffer 401 supplies 2W samples of L-channel audio signal to a connection waveform generator 403. The R-channel input buffer 405 supplies 2W samples of R-channel audio signal to a connection waveform generator 407. The connection waveform generator 403 converts the received 2W samples of L-channel audio signal into W samples of audio signal by performing the cross-fading process.

The connection waveform generator 407 converts the received 2W samples of R-channel audio signal into W samples of audio signal by performing the cross-fading process.

The audio signal stored in the L-channel input buffer 401 and the audio signal produced by the connection waveform generator 403 are supplied to an output buffer 404 in accordance with a speech speed conversion ratio R. The audio signal stored in the R-channel input buffer 405 and the audio signal produced by the connection waveform generator 407 are supplied to an output buffer 408 in accordance with the speech speed conversion ratio R. The output buffer 404 combines the received audio signals thereby producing an L-channel audio signal, and the output buffer 408 combines the received audio signals thereby producing an R-channel audio signal. The resultant R and L-channel audio signals are output from the speech speed conversion apparatus 400.

The process performed by the similar-waveform length detector 402 configured as shown in FIG. 35 is performed in a similar manner to that shown in FIGS. 30 and 31 except that the R-channel audio signal or the L-channel audio signal with greater energy is selected by channel selector 409 and supplied to the similar-waveform length detector 402.

As described above with reference to FIGS. 22 to 35, it is possible to expand or compress an audio signal at an arbitrary speech speed conversion ratio R ($0.5 \leq R < 1.0$ or $1.0 < R \leq 2.0$) according to the speech speed conversion algorithm (PICOLA) even for stereo signals without causing a fluctuation in location of the sound source.

SUMMARY OF THE INVENTION

Although the configurations shown in FIGS. 33 and 35 can change the speech speed without causing a difference in synchronization between right and left channels, another problem can occur. In the case of the configuration shown in FIG. 33, if there is a large phase difference at a particular frequency between R and L channels, a great reduction in amplitude of the signal occurs when a stereo signal is converted into a monaural signal. In the configuration shown in FIG. 35, the similar-waveform length is determined based on only one of channels having greater energy, and information of a channel with lower energy has no contribution to the determination of the similar-waveform length.

The problems with the configuration shown in FIG. 33 are described in further detail below with reference to FIGS. 36 to 38. FIG. 36 illustrates what happens if there is a difference in phase between right and left channels in the conversion from a stereo signal including right and left signal components at a particular frequency to a monaural signal.

Reference numeral 3601 denotes a waveform of an L-channel audio signal, and reference numeral 3602 denotes a waveform of an R-channel audio signal. There is no phase difference between these two waveforms. Reference numeral 3603 denotes a waveform of a monaural signal obtained by determining the average of the sample values of the L and R-channel audio signals 3601 and 3602. Reference numeral 3604 denotes a waveform of an L-channel audio signal, and reference numeral 3605 denotes a waveform of an R-channel audio signal having a phase difference of 90° with respect to the phase of the waveform 3604. Reference numeral 3606 denotes a waveform of a monaural signal obtained by determining the average of the sample values of the L and R-channel audio signals 3604 and 3605. As shown in FIG. 36, the amplitude of the waveform 3606 is smaller than that of the original waveform 3604 or 3605. Reference numeral 3607 denotes a waveform of an L-channel audio signal, and reference numeral 3608 denotes a waveform of an R-channel audio signal having a phase difference of 180° with respect to the phase of the waveform 3607. Reference numeral 3609 denotes a waveform of a monaural signal obtained by determining the average of the sample values of the L and R-channel audio signals 3607 and 3608. As shown in FIG. 36, the waveform 3607 and the waveform 3608 cancel out each other, and, as a result, the amplitude of the waveform 3609 becomes 0. As described above, the phase difference between R and L channels can cause a reduction in amplitude when a stereo signal is converted into a monaural signal.

FIG. 37 illustrates an example of a problem which can occur when a stereo signal having a phase difference of 180° between R and L channel components is converted into a monaural signal.

In this example, the L-channel signal includes a waveform 3701 with a small amplitude and a waveform 3702 with a large amplitude. The R-channel signal includes a waveform 3703 having the same amplitude and the same frequency as those of the waveform 3702 of the L-channel but having a phase different from that of the waveform 3702 by 180°. If a monaural signal is produced simply by determining the average of the L and R channel signals, cancellation occurs between the L-channel waveform 3702 and the R-channel waveform 3703, and only the waveform 3701 in the original L-channel signal survives in the monaural signal.

If the similar-waveform length is determined using this monaural signal 3704, and the L-channel signal including the waveform 3701 and the waveform 3702 and the R-channel signal including the waveform 3703 are expanded by a factor of 2 in length on the basis of the determined similar-waveform length W, the result is that an expanded waveform L' (3801+3802) is obtained for the left channel and an expanded waveform R' (3803) is obtained for the right channel as shown in FIG. 38. That is, an interval A1×B1 is produced from an interval A1 and an interval B1, an interval A2×B2 is produced from an interval A2 and an interval B2, and an interval A3×B3 is produced from an interval A3 and an interval B3. In the present example, because the waveform expansion is performed according to the similar-waveform length detected from the monaural signal 3704, the waveform 3702 or the waveform 3703 with the large amplitude is not used in the determination of the similar-waveform length. Therefore, although the waveform 3701 is correctly expanded into a waveform 3801, the waveform 3702 and the waveform 3703 are respectively expanded into a waveform 3802 and a 3803 which are very different from the original waveform. As a result, a strange sound or noise occurs in the resultant expanded sound.

When music or the like recorded in the form of a stereo signal is played back, a listener can feel as if sounds actually came from various positions widely distributed in space. This effect is mainly due to differences in amplitude or phase between a right channel signal and a left channel signal. This means that an input signal usually has a difference in phase between right and left channels, and thus, if the above-described technique used, the difference in phase can cause a strange sound or noise to occur in the expanded or compressed sound.

In view of the above, it is desirable to provide an audio signal expanding/compressing apparatus and an audio signal expanding/compressing method, capable of changing a playback speed without creating degradation in sound quality and without creating a fluctuation in location of a reproduced sound source.

According to an embodiment of the present invention, there is provided an audio signal expanding/compressing apparatus adapted to expand or compress, in a time domain, a plurality of channels of audio signals by using similar waveforms, comprising similar waveform length detection means for calculating similarity of the audio signal between two successive intervals for each channel, and detecting a similar-waveform length of the two intervals on the basis of the similarity of each channel.

According to an embodiment of the present invention, there is provided a method of expanding or compressing, in a time domain, a plurality of channels of audio signal by using similar waveforms, comprising the step of detecting a similar-waveform length by calculating similarity of the audio signal between two successive intervals for each channel, and detecting the similar-waveform length of the two intervals on the basis of the similarity of each channel.

As described above, the present invention has the great advantage that the similarity of the audio signal between two successive intervals is calculated for each of a plurality of channels, and the similar-waveform length of the two intervals is determined on the basis of the similarity, and thus it is possible to change the playback speed without creating degradation in sound quality and without creating a fluctuation in location of a reproduced sound source.

DESCRIPTION OF THE PREFERRED EMBODIMENTS

The present invention is described in further detail below with reference to specific embodiments in conjunction with the accompanying drawings. In the embodiments described below, an audio signal is expanded or compressed by calculating the similarity of the audio signal between two successive intervals for each of a plurality of channels, detecting the similar-waveform length of the two intervals on the basis of the similarity of each channel, and expanding/compressing the audio signal in time domain on the basis of the determined similar-waveform length, whereby it becomes possible to perform the speech speed conversion without creating a difference in synchronization between channels and without being influenced by a difference in phase of signal at a frequency between channels.

Figure 1:
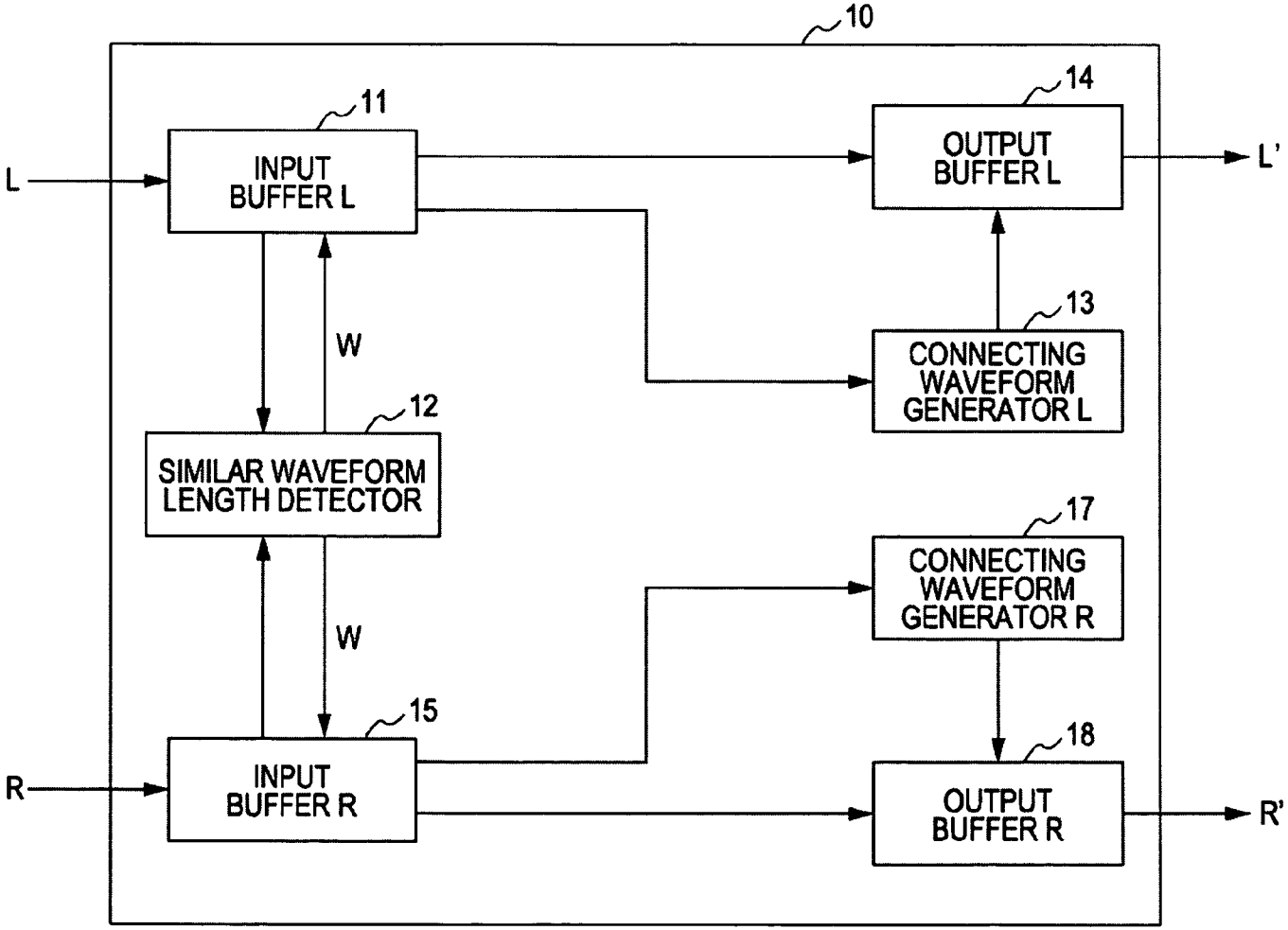
FIG. 1 is a block diagram illustrating an audio signal expanding/compressing apparatus according to an embodiment of the present invention.

FIG. 1 is a block diagram illustrating an audio signal expanding/compressing apparatus according to an embodiment of the present invention. The audio signal expanding/compressing apparatus 10 includes an input buffer L11 adapted to buffer an input audio signal of an L channel, an input buffer R15 adapted to buffer an input audio signal of an R channel, a similar-waveform length detector 12 adapted to detect a similar-waveform length W for the audio signals stored in the input buffer L11 and the input buffer R15, an L-channel connection-waveform generator L13 adapted to generate a connection waveform including W samples by cross-fading 2W samples of audio signal, an R-channel connection-waveform generator R17 adapted to generate a connection waveform including W samples by cross-fading 2W samples of audio signal, an output buffer L14 adapted to output an L-channel output audio signal using the input audio signal and the connection waveform in accordance with a speech speed conversion ratio R, and an output buffer R18 adapted to output an R-channel output audio signal using the input audio signal and the connection waveform in accordance with the speech speed conversion ratio R.

When an audio signal to be processed is input, an L-channel signal is stored in an input buffer L11, and an R-channel signal is stored in an input buffer R15. The similar-waveform length detector 12 detects a similar-waveform length W for the audio signals stored in the input buffer L11 and the input buffer R15. More specifically, the similar-waveform length detector 12 determines the sum of squares of differences (mean square errors) separately for each of the audio signal stored in the L-channel input buffer L11 and the audio signal stored in the R-channel input buffer R15. The mean square error is used as a measure indicating the similarity between two waveforms in an audio signal.

$$DL(j)=(1/j)\Sigma\{fL(i)-fL(j+i)\}^2(i=0 \text{ to } j-1) \quad (13)$$

$$DR(j)=(1/j)\Sigma\{fR(i)-fR(j+i)\}^2(i=0 \text{ to } j-1) \quad (14)$$

where fL is the value of an i-th sample of the L-channel signal, fR is the value of an i-th sample of the R-channel signal, DL(j) is the sum of squares of differences (mean square errors) between sample values in two intervals of the L-channel signal, and DR(j) is the sum of squares of differences (mean square errors) between sample values in two intervals of the R-channel signal. Next, a function D(j) given by the sum of DL(j) and DR(j) is calculated.

$$D(j)=DL(j)+DR(j) \quad (15)$$

The value of j for which the function D(j) has a minimum value is determined, and W is set to j (W=j). The similar-waveform length W given by j is used in common as the similar-waveform length W for the R-channel audio signal and the L-channel audio signal.

The similar-waveform length W determined by the similar-waveform length detector 12 is supplied to the input buffer L11 of the L channel and the input buffer R15 of the R channel so that the similar-waveform length W is used in a buffering operation. The L-channel input buffer L11 supplies 2W samples of L-channel audio signal to the connection waveform generator L13, and the R-channel input buffer R15 supplies 2W samples of R-channel audio signal to the connection waveform generator R17. The connection waveform generator L13 converts the received 2W samples of L-channel audio signal into W samples of audio signal by performing the cross-fading process. Similarly, the connection waveform generator R17 converts the received 2W samples of R-channel audio signal into W samples of audio signal by performing the cross-fading process. The audio signal stored in the L-channel input buffer L11 and the audio signal produced by the connection waveform generator L13 are supplied to the output buffer L14 in accordance with the speech speed conversion ratio R. Similarly, the audio signal stored in the R-channel input buffer R15 and the audio signal produced by the connection waveform generator R17 are supplied to the output buffer R18 in accordance with the speech speed conversion ratio R. The output buffer L14 combines the received audio signals thereby producing an L-channel audio signal, and the output buffer R18 combines the received audio signals thereby producing an R-channel audio signal. The resultant audio signals are output from the audio signal expanding/compressing apparatus 10.

In the above-described calculation of the similarity between two intervals of the input audio signal, the similarity is first calculated separately for each channel, and then an optimum value is determined based on the similarity calculated for each channel. This makes it possible to correctly detect a similar-waveform length even for a stereo signal having a phase difference between channels without being influenced by the phase difference.

Figure 2:
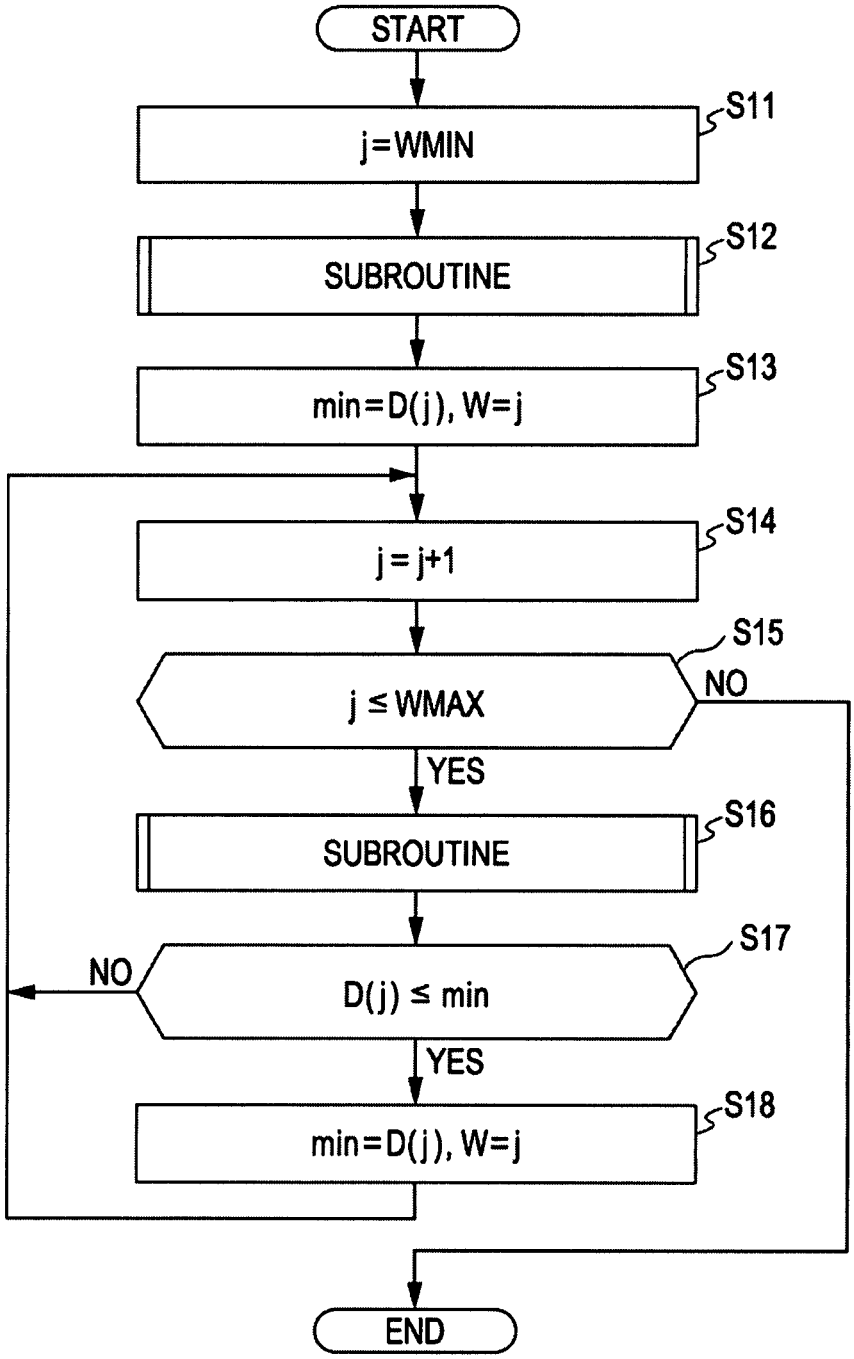
FIG. 2 is a flow chart illustrating a process performed by a similar-waveform length detector.
Figure 30:
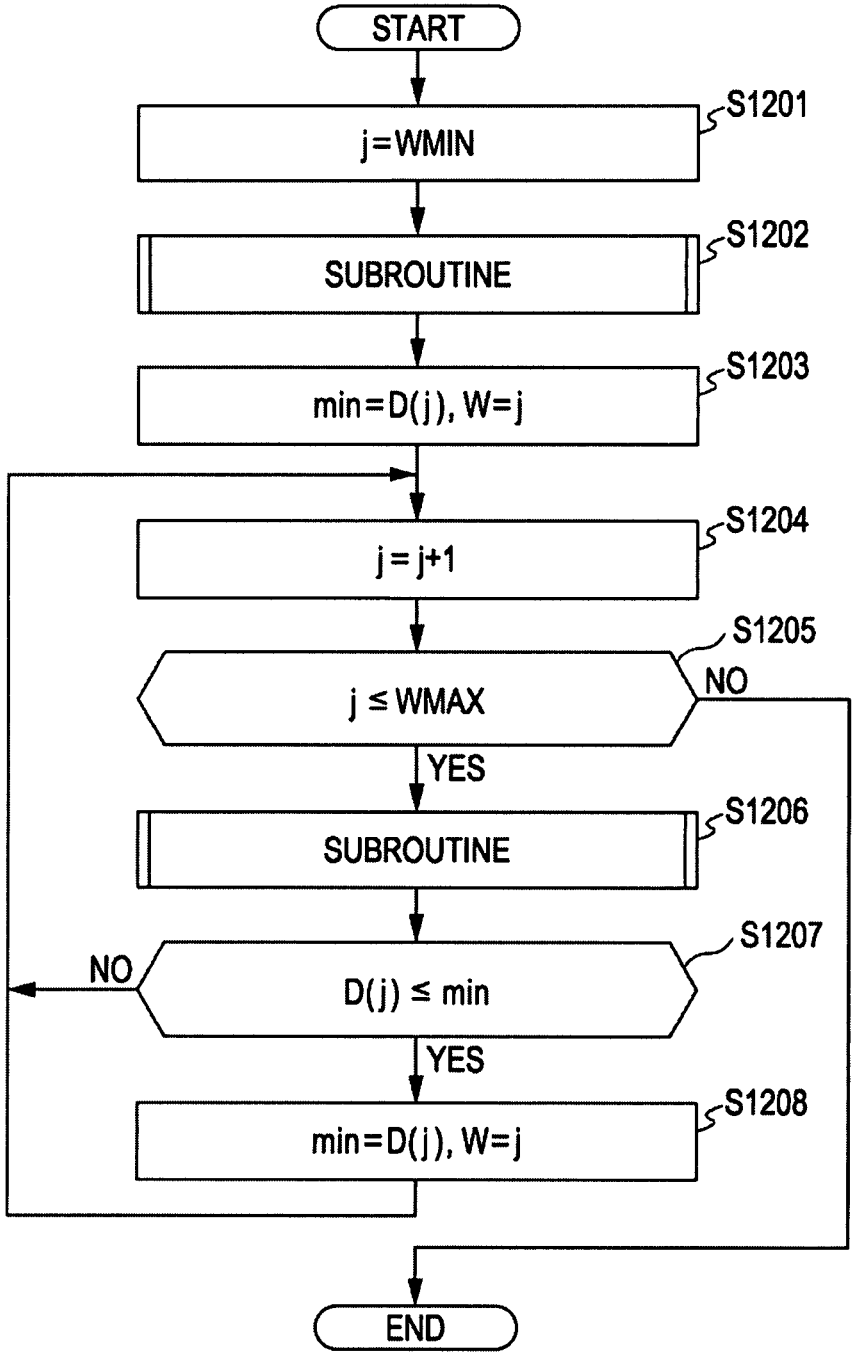
FIG. 30 is a flow chart illustrating a process of detecting a similar-waveform length for a monaural signal.
Figure 31:
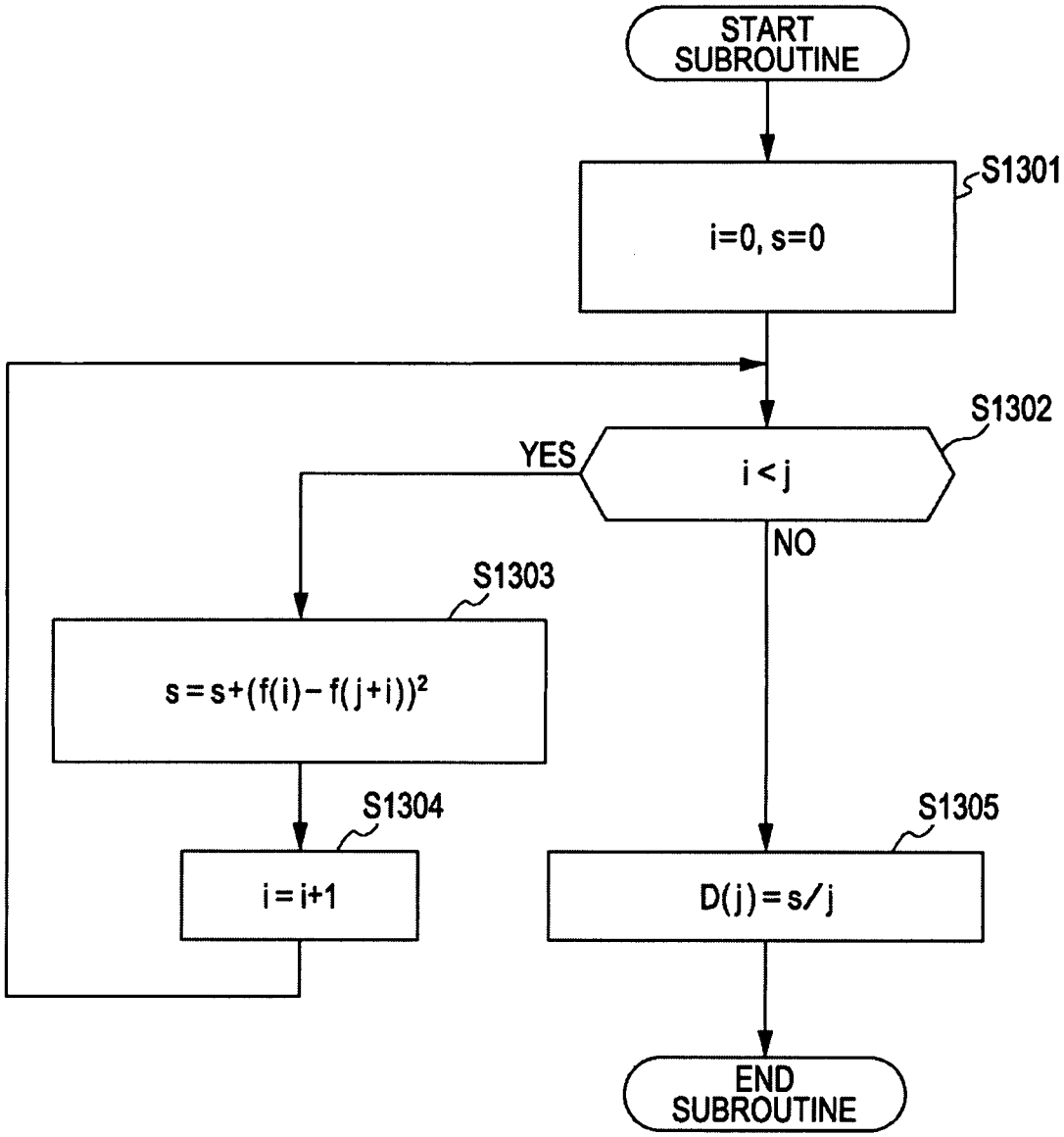
FIG. 31 is a flow chart illustrating a subroutine of calculating a function D(j) for a monaural signal.
Figure 32:
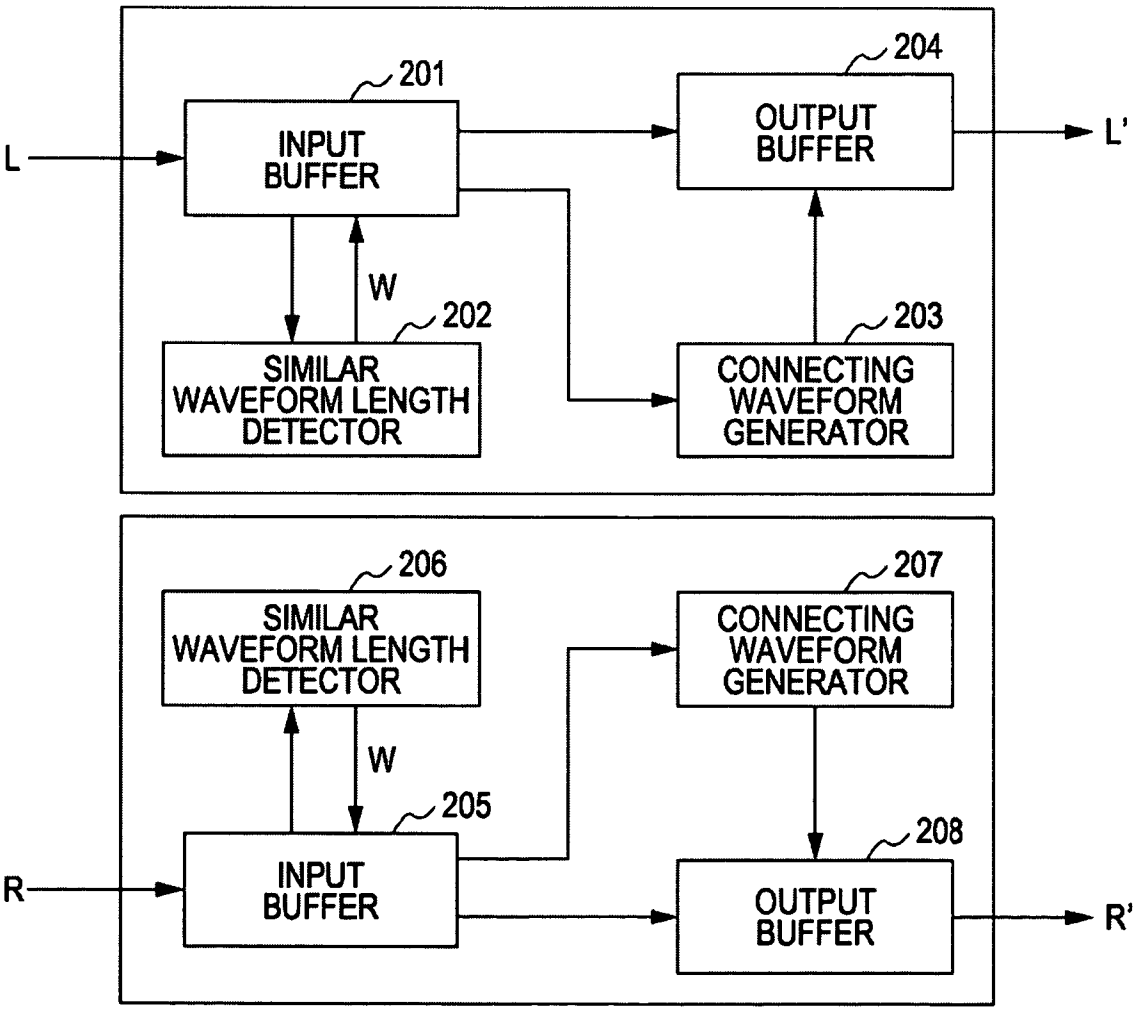
FIG. 32 is a block diagram illustrating an example of a speech speed conversion apparatus adapted to handle a stereo signal, using a PICOLA algorithm.

FIG. 2 is a flow chart illustrating the process performed by a similar-waveform length detector 12. This process is similar to that shown in FIG. 30 except that the subroutine has some difference. That is, the subroutine of calculating the value of function D(j) indicating the similarity between two waveforms is replaced from that shown in FIG. 31 to that shown in FIG. 3.

Figure 3:
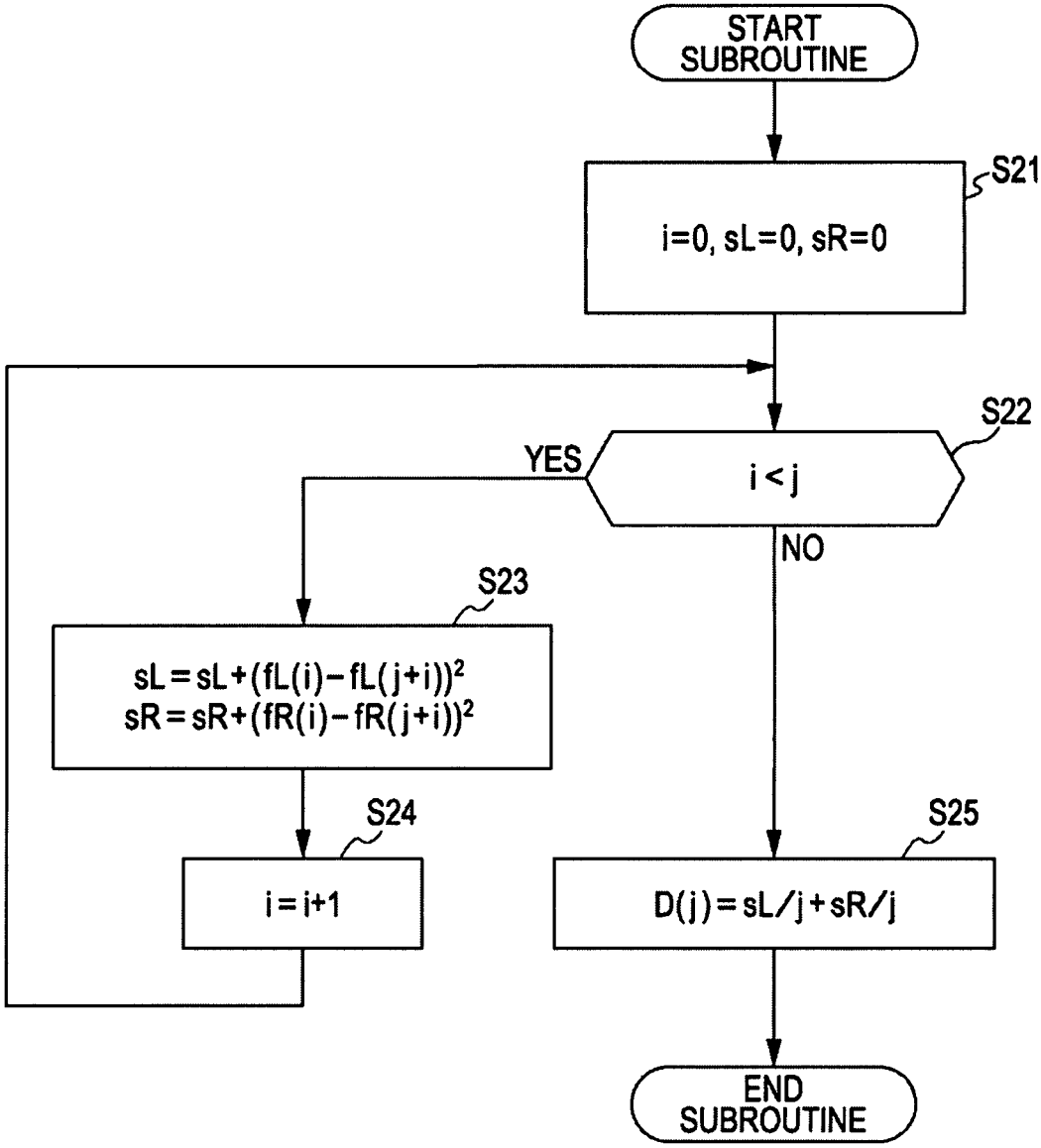
FIG. 3 is a flow chart illustrating a subroutine of calculating a function D(j)

In step S11, an index j is set to an initial value of WMIN. In step S12, a subroutine shown in FIG. 3 is executed to calculate a function D(j) given by equation (15) shown below. In step S13, the value of the function D(j) determined by executing the subroutine is substituted into a variable MIN, and the index j is substituted into W. In step S14, the index j is incremented by 1. In step S15, a determination is made as to whether the index j is equal to or smaller than WMAX. If the index j is equal to or smaller than WMAX, the process proceeds to step S16. However, if the index j is greater than WMAX, the process is ended. The value of the variable W obtained at the end of the process indicates the index j for which the function D(j) has a minimum value, that is, gives the similar-waveform length, and the variable MIN in this state indicates the minimum value of the function D(j).

In step S16, the subroutine shown in FIG. 3 is executed to determine the value of the function D(j) for a new index j. In step S17, it is determined whether the value of the function D(j) determined in step S16 is equal to or smaller than MIN. If the determined value is equal to or smaller than MIN, the process proceeds to step S18, but otherwise and the process returns to step S14. In step S18, the value of the function D(j) determined by executing the subroutine is substituted into the variable MIN, and the index j is substituted into W.

The subroutine shown in FIG. 3 is executed as follows. In step S21, an index i is reset to 0, and a variable sL and a variable sR are reset to 0. In step S22, it is determined whether the index i is smaller than the index j. If so the process proceeds to step S23, but otherwise the process proceeds to step S25. In step S23, the square of the difference between signals of the L channel is determined and the result is added to the variable sL, and the square of the difference between signals of the R channel is determined and the result is added to the variable sR. More specifically, the difference between the value of an i-th sample and the value of a (i+j)th sample of the L channel, and the square of the difference is added to the variable sL. Similarly, the difference between the value of an i-th sample and the value of an (i+j)th sample of the R channel, and the square of the difference is added to the variable sR. In step S24, the index i is incremented by 1, and the process returns to step S22. In step S25, the sum of the variable sL divided by the index j and the variable sR divided by the index j is calculated, and the result is employed as the value of function D(j). The subroutine is then ended. By determining the similar-waveform length in the above-described manner, it is possible to perform the speech speed conversion without creating a difference in synchronization between channels and without being influenced by a difference in phase of signal at a frequency between channels.

Figure 4:
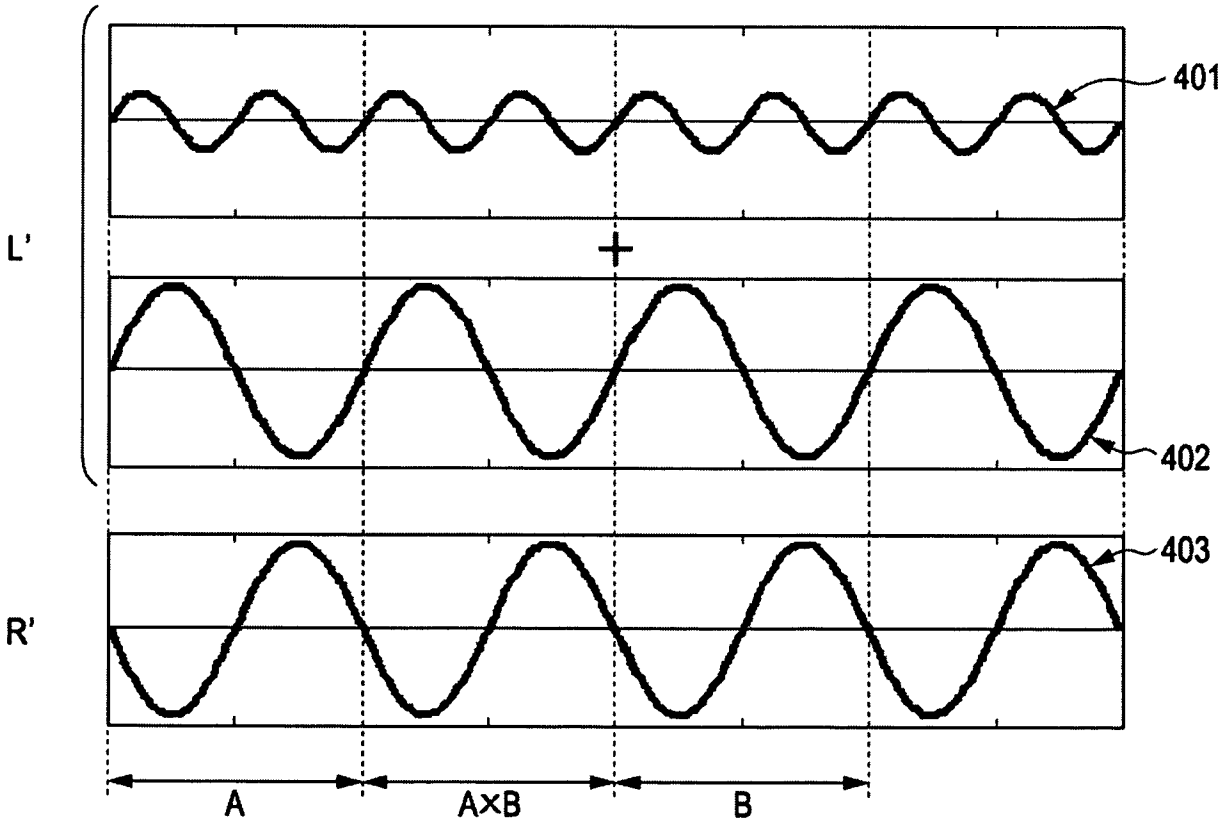
FIG. 4 illustrates an example of expansion of a waveform according to an embodiment of the present invention.
Figure 37:
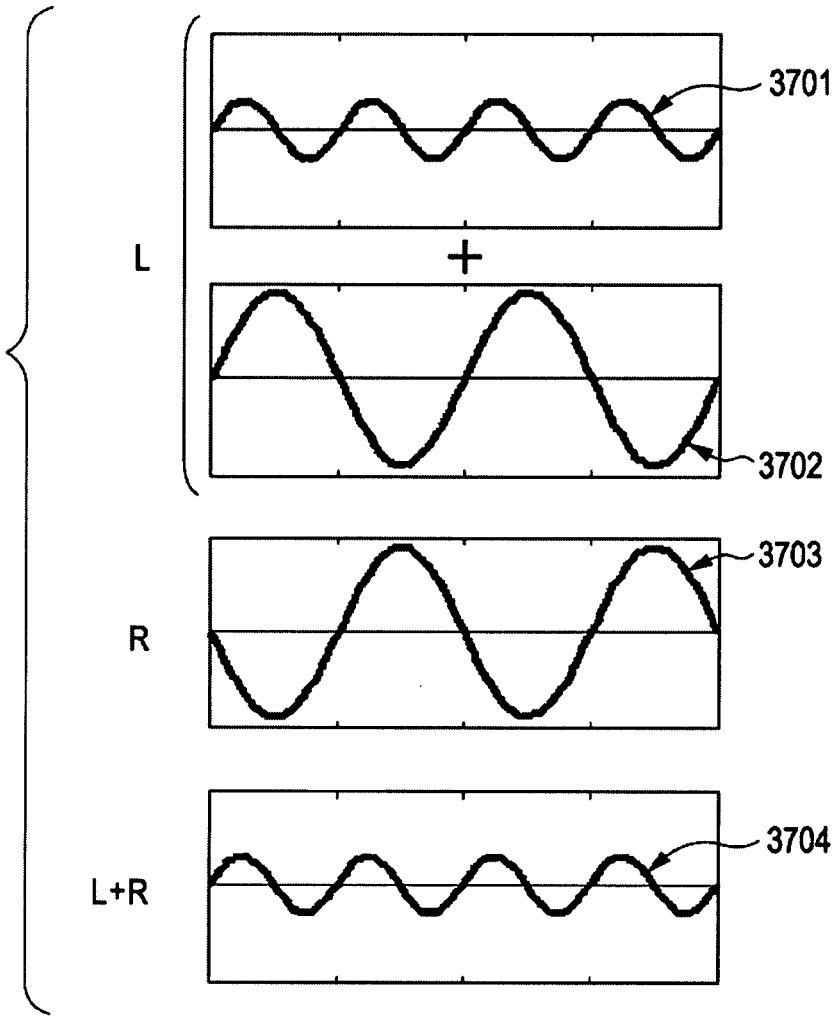
FIG. 37 illustrates an example of a problem which can occur when a stereo signal with the same frequency has a phase difference of 180° between R and L channels.

FIG. 4 illustrates an example of a result of the waveform expansion process according to the present embodiment, applied to the stereo signal including waveforms 3701 to 3703 shown in FIG. 37. In the example of the stereo signal shown in FIG. 37, the L-channel signal includes the waveform 3701 with the small amplitude and the waveform 3702 with the large amplitude, and the waveform 3701 has a frequency twice the frequency of the waveform 3702. The R-channel signal includes the waveform 3703 having the same amplitude and the same frequency as those of the waveform 3702 of the L-channel but having a phase difference of 1800 from that of the waveform 3702.

In the present embodiment of the invention, the value of function DL(j) is determined from the L-channel signal including the waveforms 3701 and 3702, and the value of function DR(j) is determined from the R-channel signal including the waveform 3703. The value of j for which the function D(j)=DL(j)+DR(j) has a minimum value is determined, and W is set to j (W=j). If the stereo signal including the waveforms 3701 to 3703 shown in FIG. 37 is expanded based on the similar-waveform length W determined above, then the result is that the waveform 3701 is expanded to a waveform 401, the waveform 3702 is expanded to a waveform 402, and the waveform 3703 is expanded to a waveform 403 as shown in FIG. 4. As can be seen from FIG. 4, the present embodiment of the invention makes it possible to correctly expand an original waveform.

Figure 5:
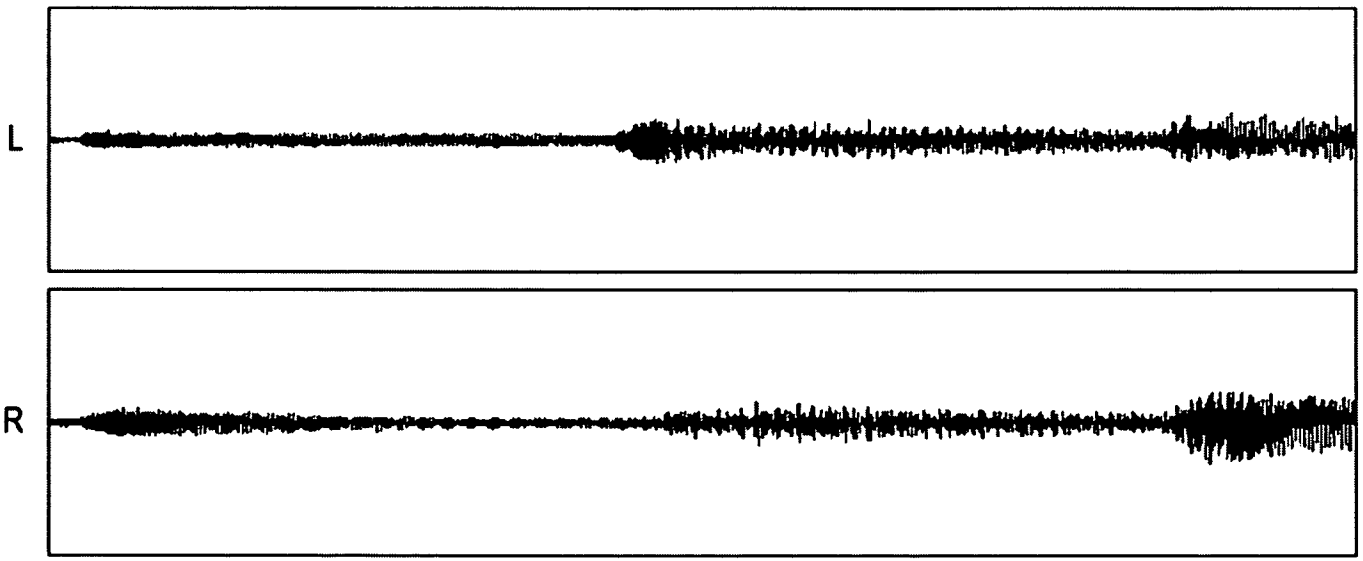
FIG. 5 illustrates an example of a stereo signal with a frequency of 44.1 kHz sampled for period of about 624 msec.
Figure 6:
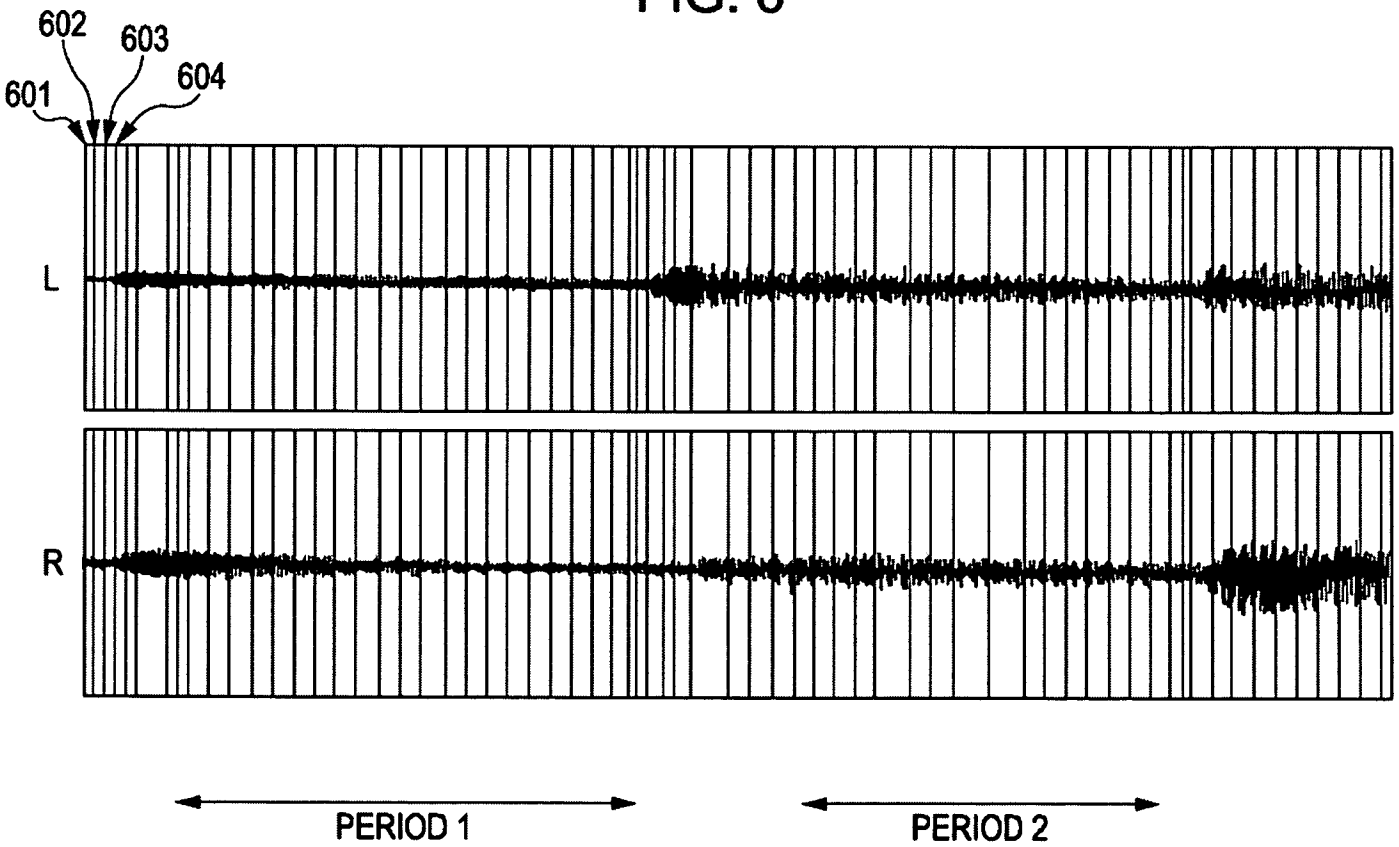
FIG. 6 illustrates an example of a result of detection of a similar-waveform length.
Figure 33:
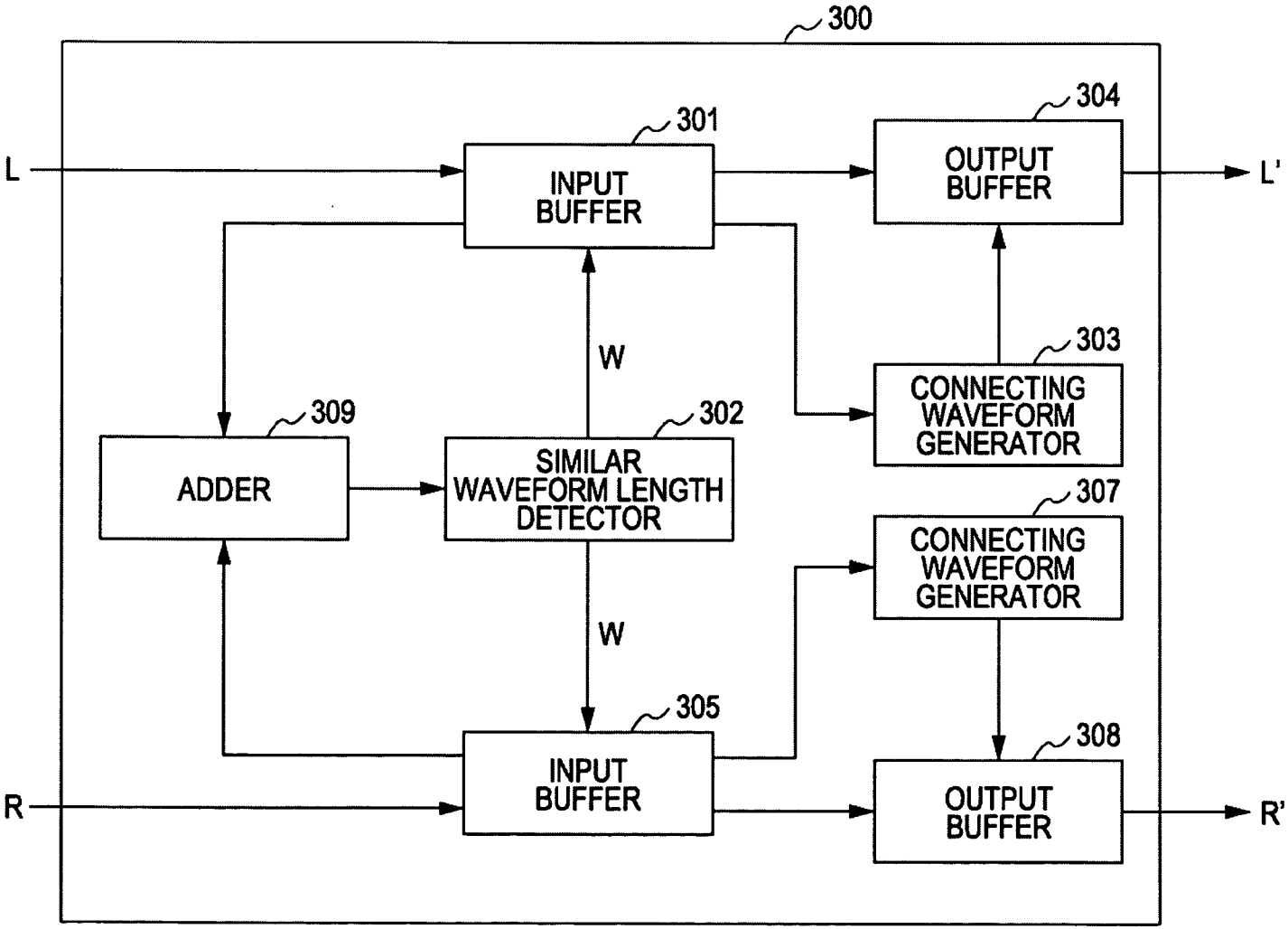
FIG. 33 is a block diagram illustrating an example of a speech speed conversion apparatus adapted to handle a stereo signal, using a PICOLA algorithm.
Figure 34:
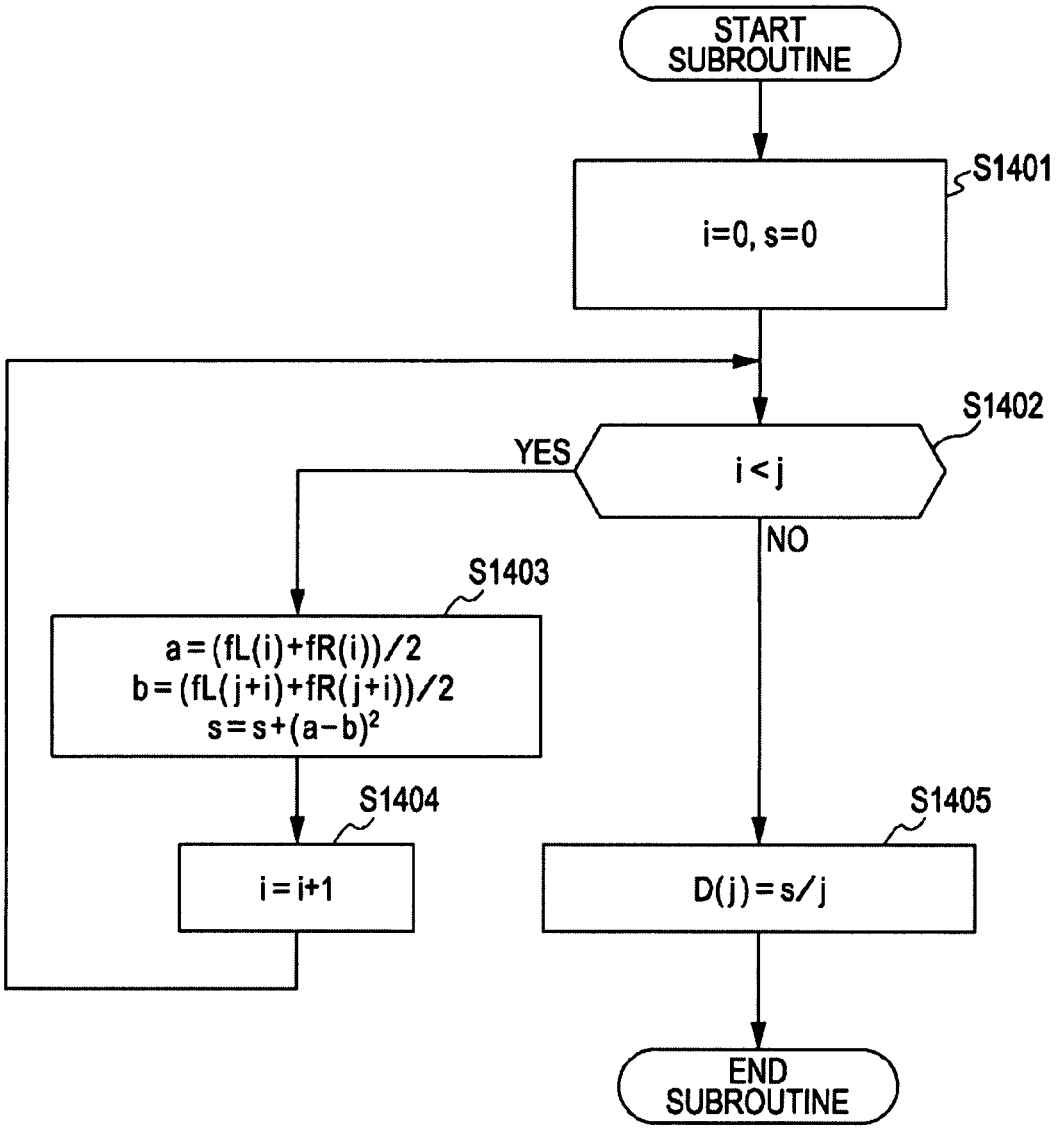
FIG. 34 is a flow chart illustrating an example of a speech speed conversion process.
Figure 35:
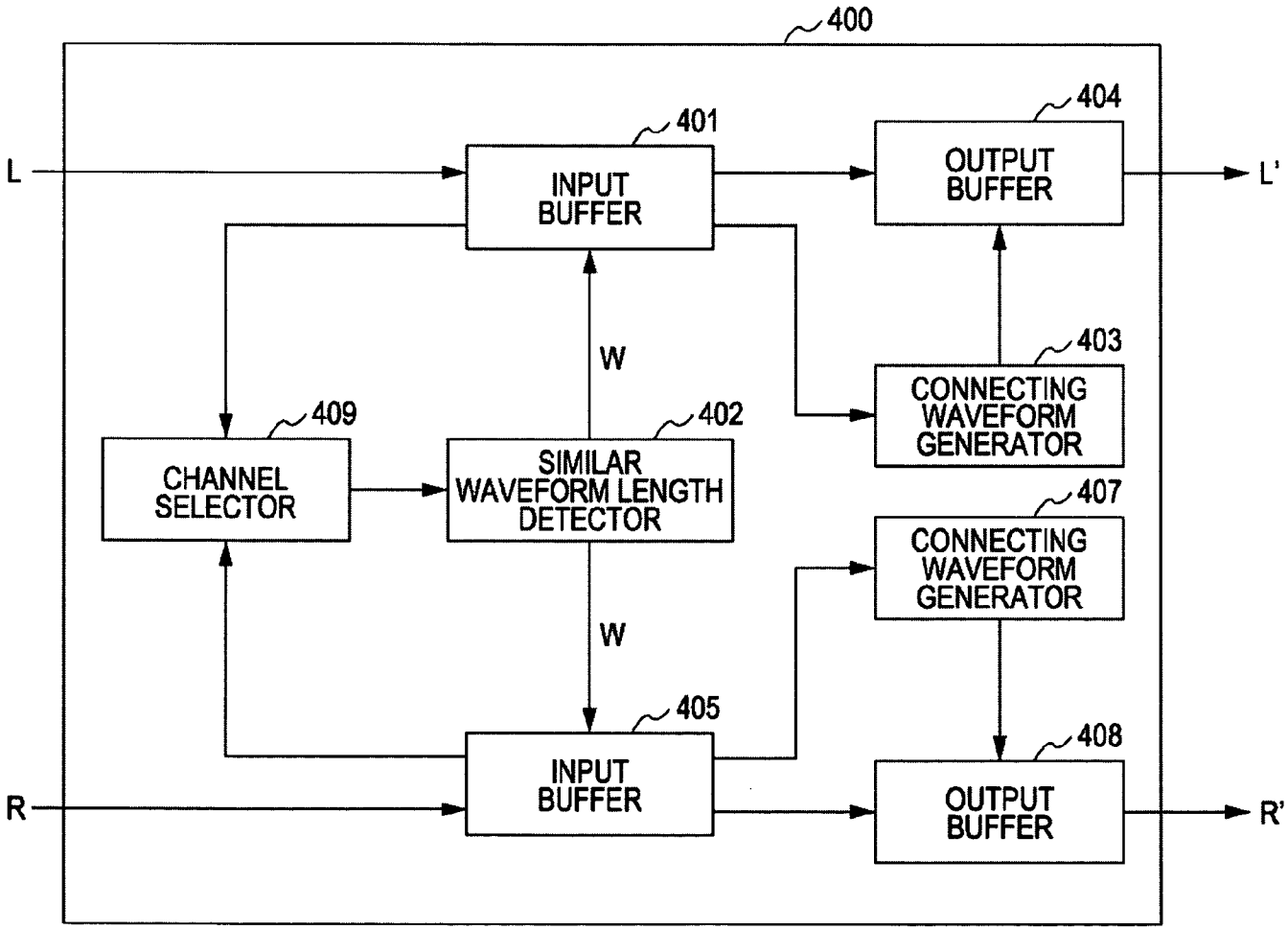
FIG. 35 is a block diagram illustrating an example of a speech speed conversion apparatus adapted to handle a stereo signal, using a PICOLA algorithm.
Figure 36:
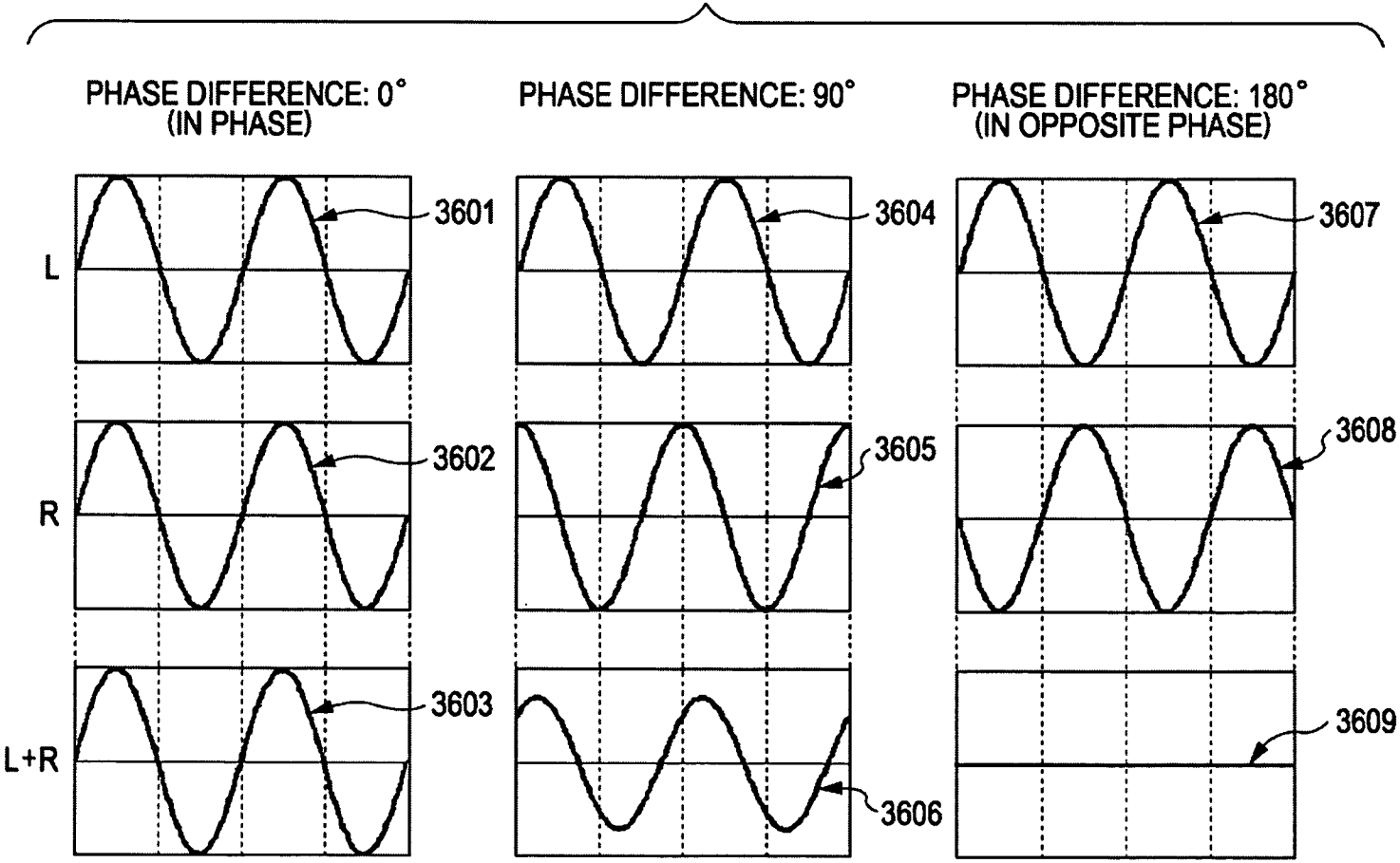
FIG. 36 illustrates what can happen if there is a difference in phase between a right channel signal and a left channel signal.

FIG. 5 illustrates an example of a stereo signal with a frequency of 44.1 kHz sampled for period of about 624 msec. FIG. 6 illustrates an example of a result of the similar-waveform length detection according to the conventional technique shown in FIG. 33, for the stereo signal including the waveforms shown in FIG. 5.

First, a similar-waveform length W1 is determined by setting the start point at a point 601. Next, a similar-waveform length W2 is determined by setting the start point at a point 602 apart from the point 601 by the similar-waveform length W1. Next, a similar-waveform length W3 is determined by setting the start point at a point 603 apart from the point 602 by the similar-waveform length W2. The above-process is performed repeatedly until all similar-waveform lengths are determined for the entire given signal as shown in FIG. 6. In the example shown in FIG. 6, although the similar-waveform length is substantially constant in a period 1, the similar-waveform length fluctuates in a period 2, which can cause an unnatural or strange sound to occur in a sound reproduced from the waveform generated by the technique described above with reference to FIG. 33.

Figure 7:
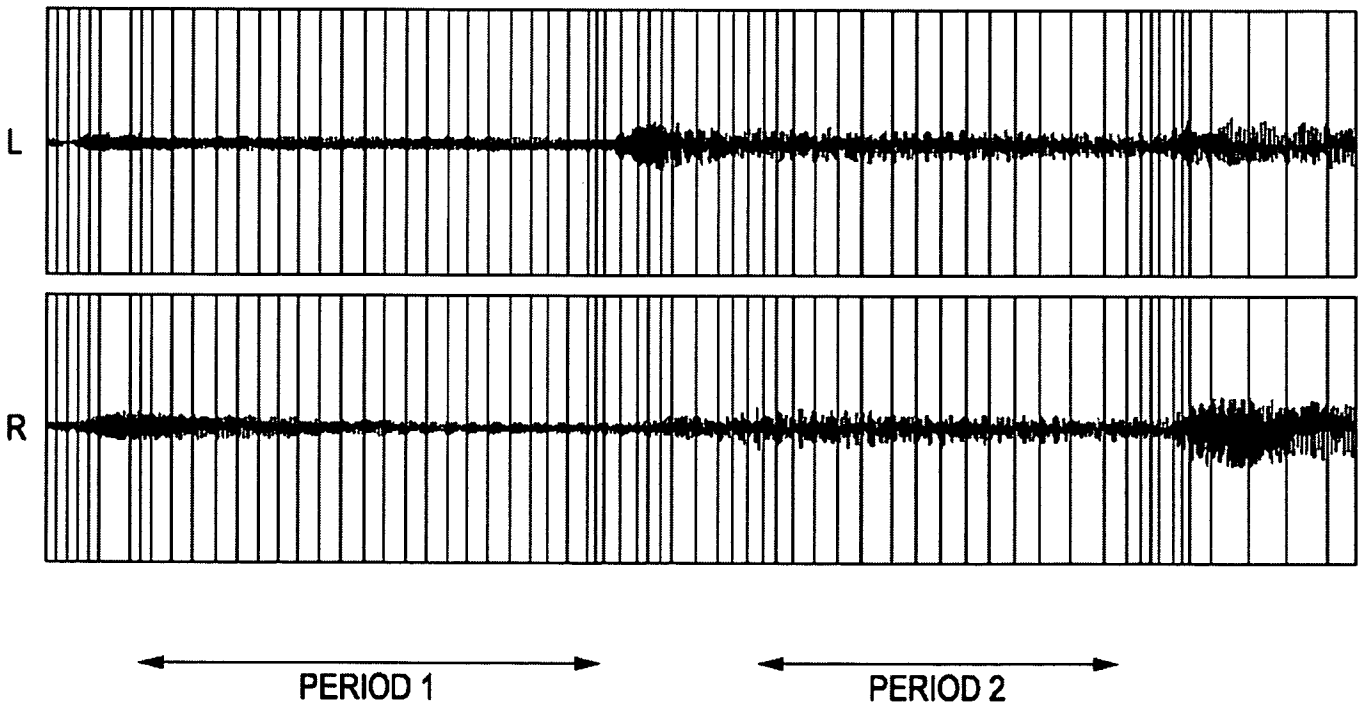
FIG. 7 illustrates an example of a result of detection of a similar-waveform length according to an embodiment of the present invention.

FIG. 7 illustrates an example of a result of detection of a similar-waveform length for the waveforms shown in FIG. 5, according to the present embodiment of the invention. In this example shown in FIG. 7, in contrast to the result shown in FIG. 6 in which the similar-waveform length varies randomly in the period 2, the similar-waveform length is more precisely determined in the period 2 and has no fluctuation. Thus, when the waveform produced by the audio signal expanding/compressing apparatus configured as shown in FIG. 1 according to the present embodiment of the invention is played back, the resultant reproduced sound includes no unnatural sounds.

Figure 8A:
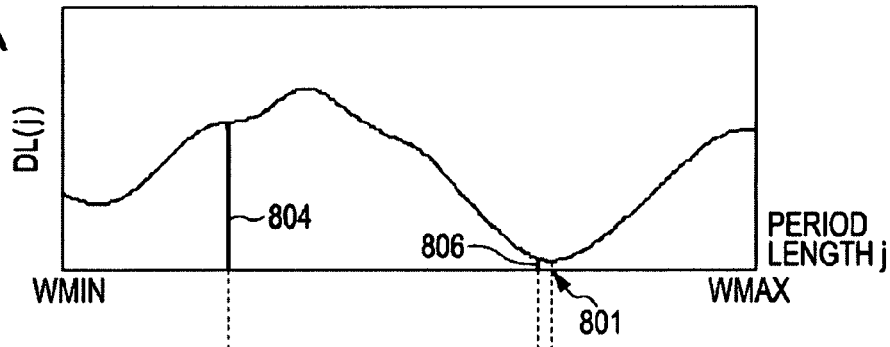
FIGS. 8A to 8C illustrate similar-waveform lengths determined using a function DL(j), a function DR(j), and a function DL(j)+DR(j), respectively.
Figure 8B:
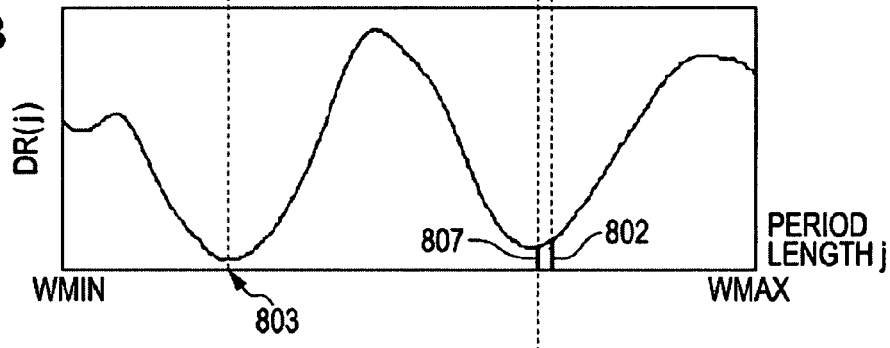
Figure 8C:
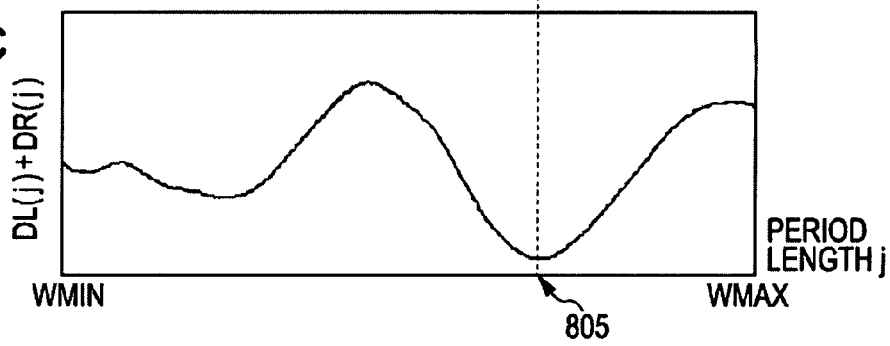

In the process of expanding/compressing the audio signal according to the present embodiment, the similar-waveform length is determined using the function D(j) given by equation (15). If the function DL(j) given by equation (13) or the function DR(j) given by equation (14) is directly used in stead of the function D(j) given by equation (15), then the result will be as shown in FIGS. 8A to 8C. FIG. 8A is a graph showing the function DL(j) determined for the L-channel of input stereo signal, and FIG. 8B is a graph showing the function DR(j) determined for the R-channel of input stereo signal.

Figure 38:
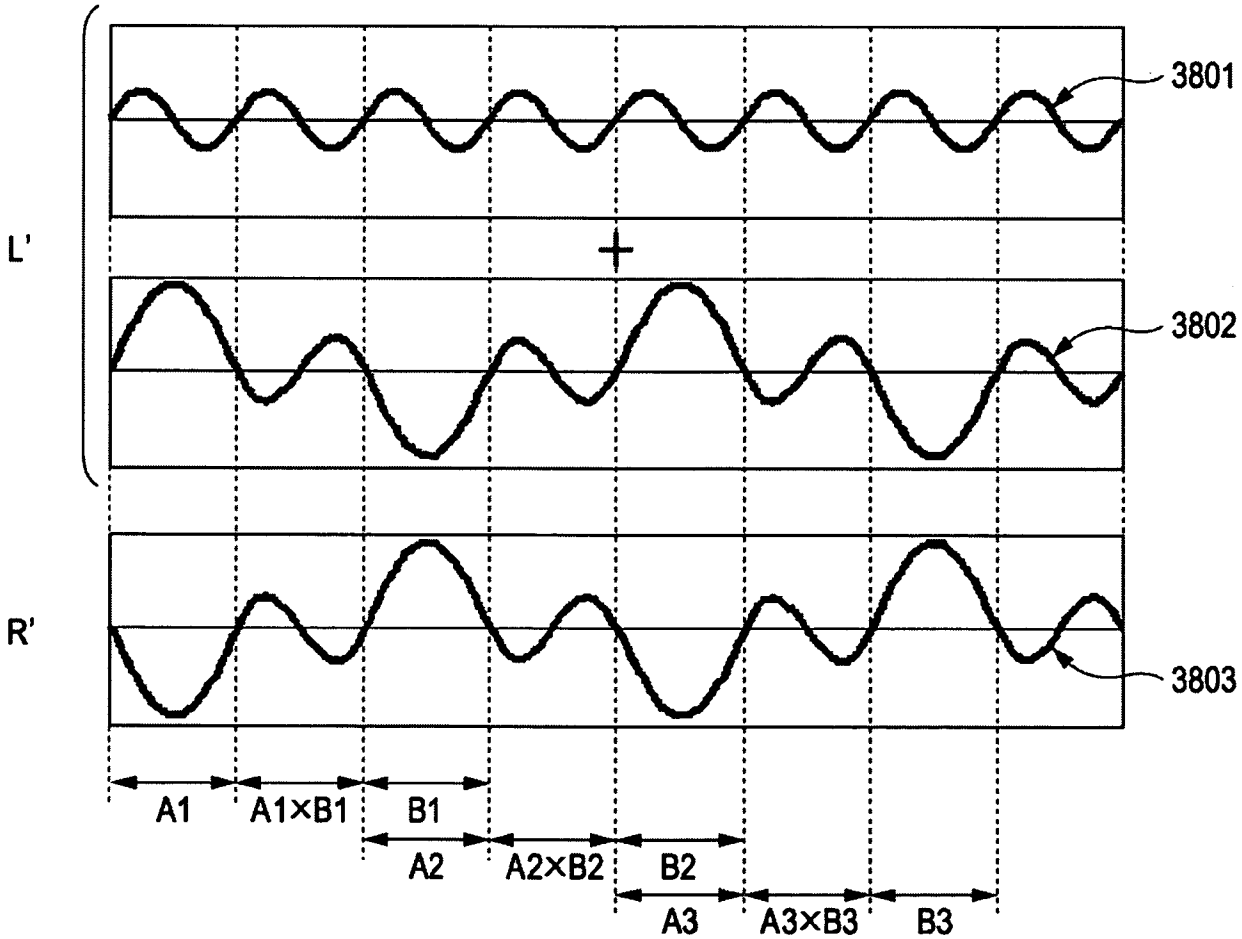
FIG. 38 illustrates an example of a result of a waveform expansion for a stereo signal having a phase difference of 180° between R and L channels.

In a case where the similar-waveform length for both channels is determined based on the function DL(j) determined from the L-channel signal, the following problem can occur. The function DL(j) has a minimum value at a point 801. If the value of j at this point 801 is employed as the similar-waveform length WL, and the speech conversion is performed for both channels based on this similar-waveform length WL, the conversion for the L channel is performed with a least error. However, for the R channel, the conversion is not performed with a least error, but an error DR(WL) (802) occurs. Conversely, in a case where the similar-waveform length for both channels is determined based on the function DR(j) determined from the R-channel signal, the following problem can occur. The function DR(j) has a minimum value at a point 803. If the value of j at this point 803 is employed as the similar-waveform length WR, and the speech conversion is performed for both channels based on this similar-waveform length WR, the conversion for the R channel is performed with a least error. However, for the L channel, the conversion is not performed with a least error, but an error DL(WR) (804) occurs. Note that the error DL(WR) (804) is very large. Such a large error causes the waveform obtained as the speech speed conversion to have a waveform very different from the original waveform as in the case where the waveform 3703 shown in FIG. 37 is converted into the very different waveform 3803 shown in FIG. 38.

In contrast, in the case where the similar-waveform length is determined according to the present embodiment of the invention using the function D(j) according to equation (15) given by the sum of the function DL(j) according to equation (13) and the function DR(j) according to equation (14), the result is as follows. FIG. 8C is a graph showing the function D(j) determined by first calculating the function DL(j) for the L channel and the function DR(j) for the R channel of the input stereo signal, separately, and then calculating the sum of the function DL(j) and the function DR(j). The function D(j) has a minimum value at a point 805. If the value of j at this point 805 is employed as the similar-waveform length W, and the speech conversion is performed for both channels based on this similar-waveform length W, the result has a minimum error between the L and R channels. That is, an L-channel error DL(W) (806) and an R-channel error DR(W) (807) are both very small.

As described above, simple use of only one of functions DL(j) and DR(j) in determination of the similar-waveform length for both channels can cause a large error such as the error 804 to occur. In contrast, in the present embodiment of the invention, the function D(j) according to equation (15) which is the sum of the function DL(j) and the function DR(j) determined separately is used, and thus it is possible to minimize the errors in both channels. Thus it is possible to achieve high-equality sound in the speech speed conversion. That is, the signal is expanded or compressed based on the common similar-waveform length for both channels in the manner described above with reference to FIGS. 1 to 3, thereby achieving high quality sound in the speech speed conversion without having a difference in synchronization between L and R channels.

Figure 9:
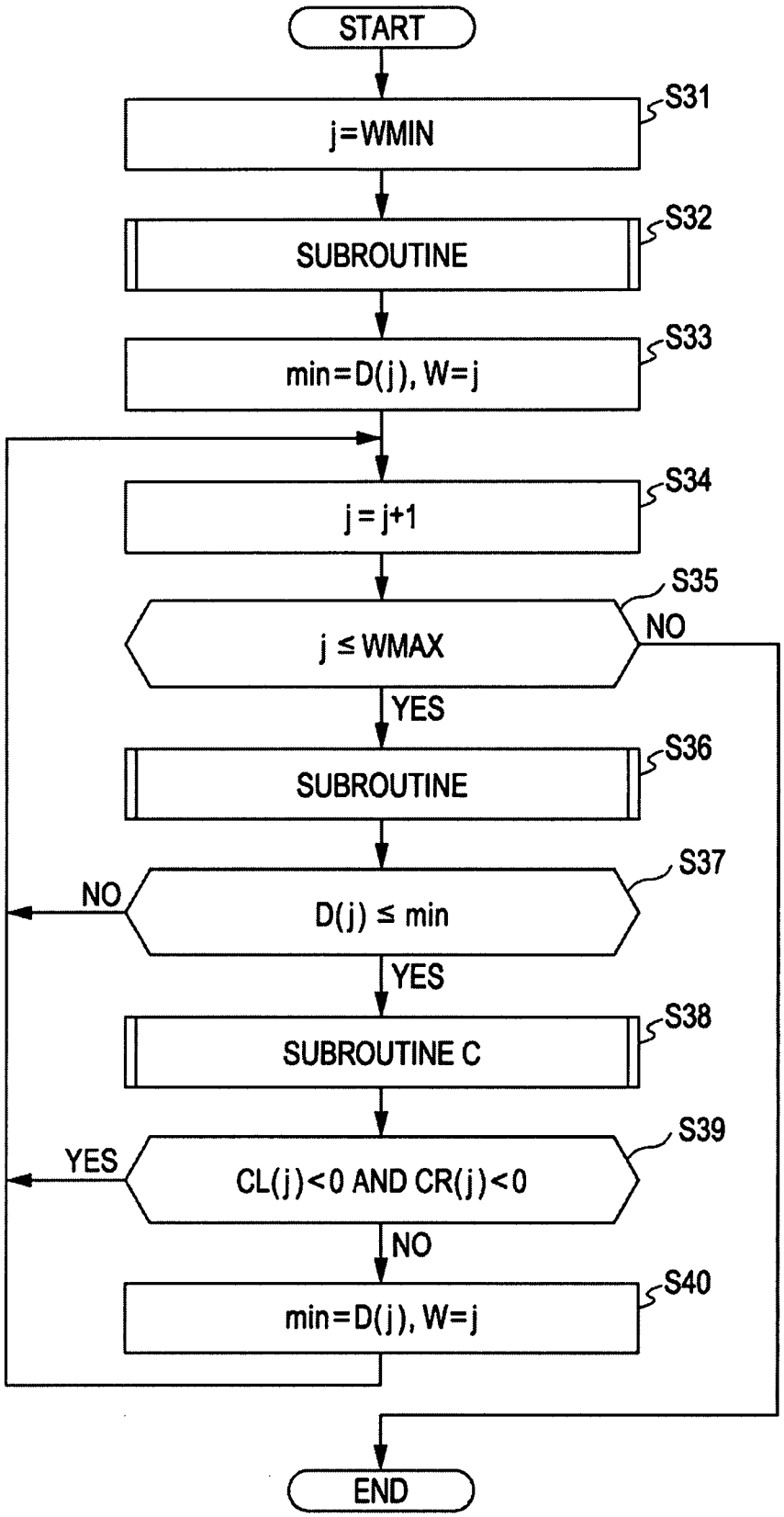
FIG. 9 is a flow chart illustrating a process performed by a similar-waveform length detector.

FIG. 9 is a flow chart illustrating another example of a process performed by the similar-waveform length detector 12. The process shown in this flow chart of FIG. 9 further includes a step of detecting the correlation between a signal in a first interval and a signal in a second interval and determining whether an interval length j thereof should be used as the similar-waveform length. Even when the function D(j) indicating the measure of the similarity has a small value for an interval length j, if the correlation coefficient of the signal between the first interval and the second interval is negative in both R and L channels, a great cancellation can occur in the production of the connection waveform, which can cause an unnatural sound to occur. This problem can be avoided by employing the process shown in the flow chart of FIG. 9.

In step S31, an index j is set to an initial value of WMIN. In step S32, a subroutine shown in FIG. 3 is executed to calculate a function D(j) given by equation (15) shown below. In step S33, the value of the function D(j) determined by executing the subroutine is substituted into a variable MIN, and the index j is substituted into W. In step S34, the index j is incremented by 1. In step S35, a determination is made as to whether the index j is equal to or smaller than WMAX. If the index j is equal to or smaller than WMAX, the process proceeds to step S36. However, if the index j is greater than WMAX, the process is ended. The value of the variable W obtained at the end of the process indicates the index j for which the function D(j) has a minimum value and the correlation between the first interval and the second interval is high. That is, this value gives the similar-waveform length, and the variable MIN in this state indicates the minimum value of the function D(j).

Figure 10:
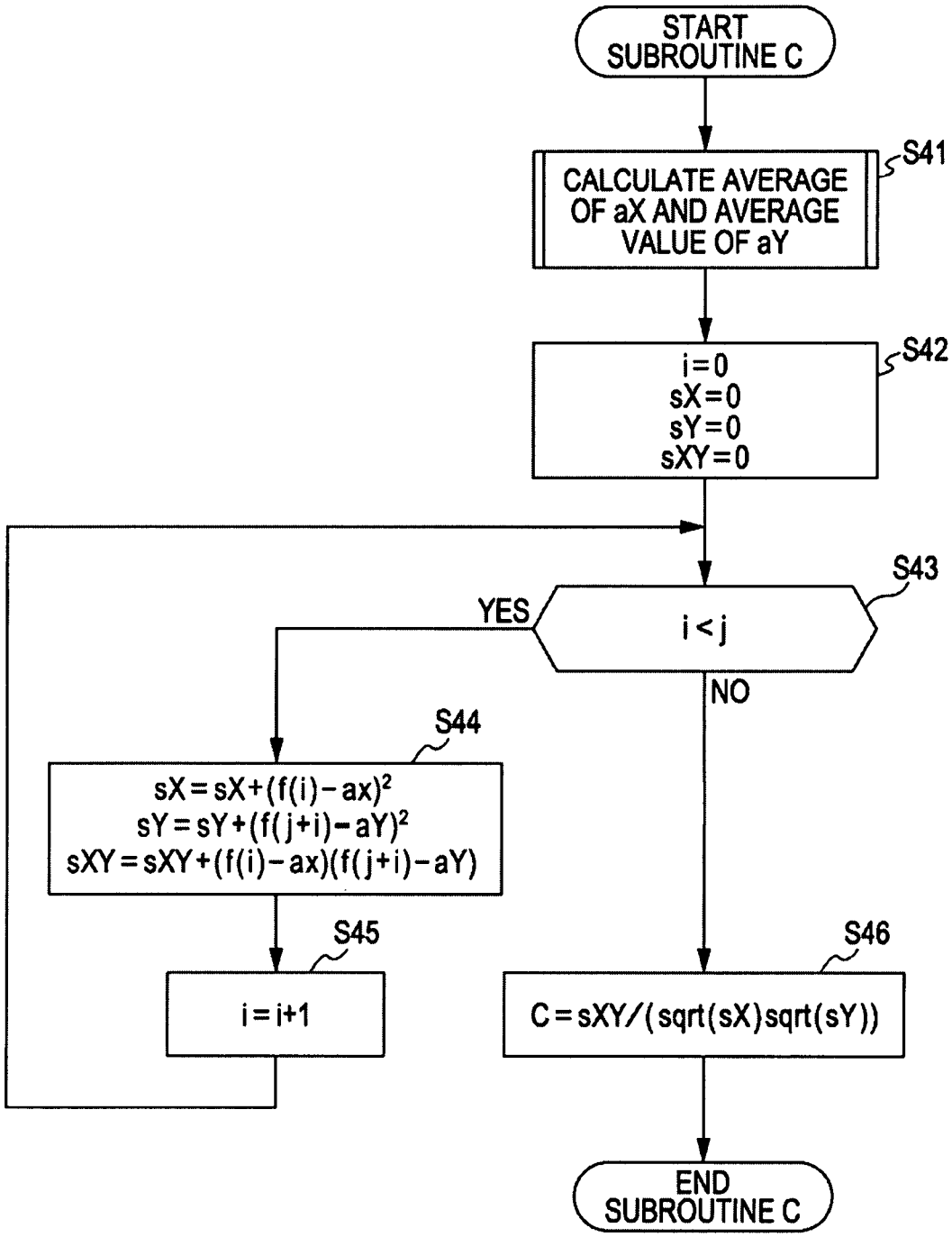
FIG. 10 is a flow chart illustrating a subroutine C of determining the correlation coefficient between a signal in a first interval and a signal in a second interval.

In step S36, the subroutine shown in FIG. 3 is executed to determine the value of the function D(j) for a new index j. In step S37, it is determined whether the value of the function D(j) determined in step S36 is equal to or smaller than MIN. If the determined value is equal to or smaller than MIN, the process proceeds to step S38, but otherwise the process returns to step S34. In step S38, a subroutine C described later with reference to FIG. 10 is executed for each of the L channel and the R channel to determine the correlation coefficient between the first interval and the second interval. The correlation coefficient determined in the above process is denoted as CL(j) for the L channel and CR(j) for the R channel.

In step S39, it is determined whether the correlation coefficients CL(j) and CR(j) determined in step S38 are both negative. If both correlation coefficients CL(j) and CR(j) are negative, the process returns to step S34, but otherwise, that is, if at least one of the coefficients is not negative, the process proceeds to step 540. In step S40, the value of the function D(j) determined by executing the subroutine is substituted into the variable MIN, and the index j is substituted into W.

Figure 11:
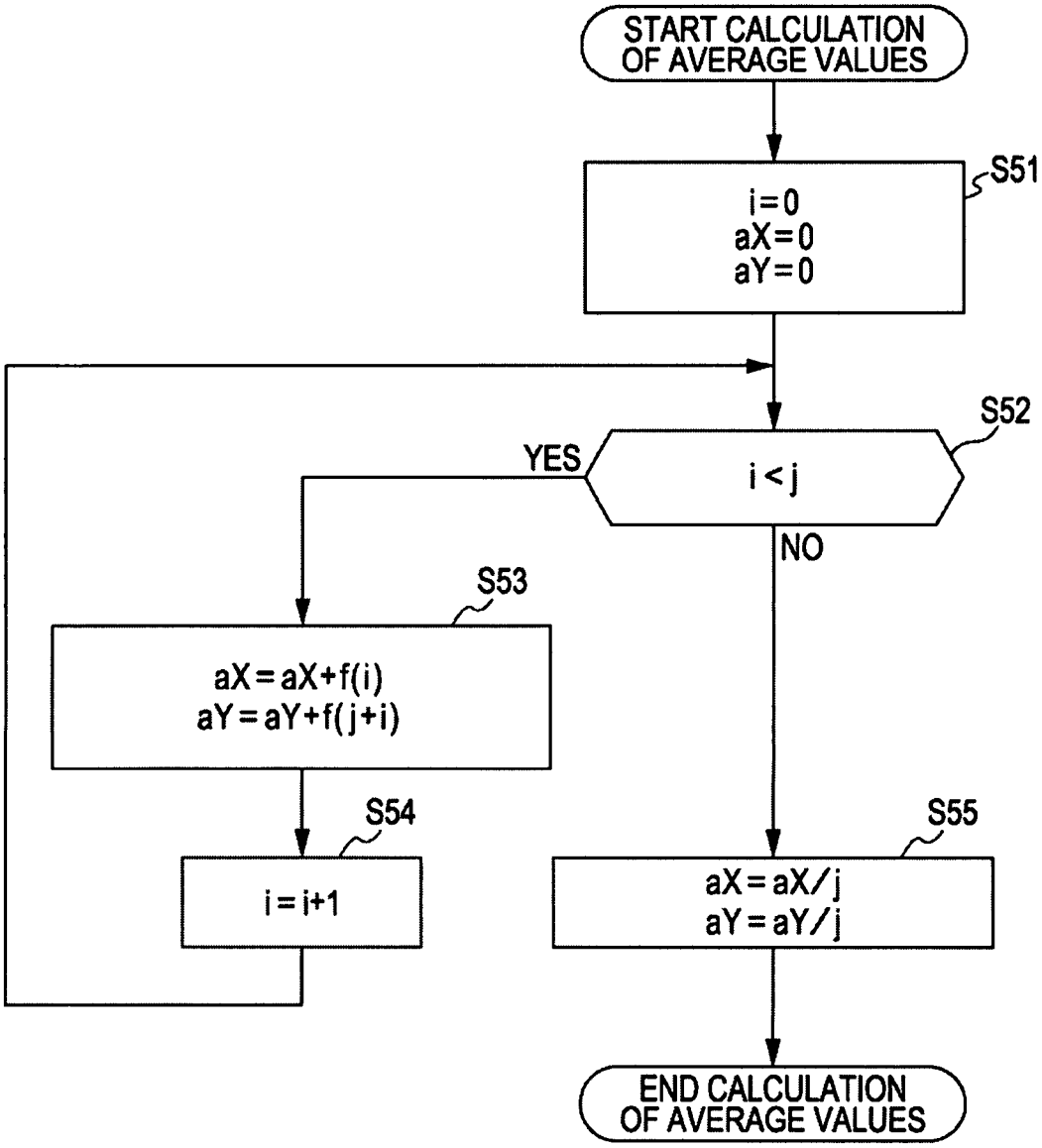
FIG. 11 is a flow chart illustrating a process of determining an average.

The details of the subroutine C are described below with reference to the flow chart shown in FIG. 10. In step S41, the average value aX of the signal in the first interval and the average value aY of the signal in the second interval are determined as shown in FIG. 11. In step S42, an index i, a variable sX, a variable sY, and a variable sXY are reset to 0. In step S43, it is determined whether the index i is smaller than the index j. If so the process proceeds to step S44, but otherwise the process proceeds to step S46. In step S44, the values of the variables sX, sY, and SXY are calculated according to the following equations.

$$sX=sX+(f(i)-aX)^2 \tag{16}$$

$$sY=sY+(f(i+j)-aY)^2 \tag{17}$$

$$sXY=sXY+(f(i)-aX)(f(i+j)-aY) \tag{18}$$

where f is the sample value input to fL or fR. In step S45, the index i is incremented by 1, and the process returns to step S44. In step S46, the correlation coefficient C is determined according to the following equation, and the subroutine C is then ended.

$$C=sXY/(sqrt(sX)sqrt(sY)) \quad (19)$$

where sqrt denotes the square root. The process described above is performed separately for L and R channels.

FIG. 11 is a flow chart illustrating a process of determining the average values. In step S51, the index i, the variable sX, and the variable sY are reset to 0. In step S52, it is determined whether the index i is smaller than the index j. If so the process proceeds to step S53, but otherwise the process proceeds to step S55. In step S53, the values of sX and SY are calculated according to the following equations.

$$aX=aX+f(i) \quad (20)$$

$$aY=aY+f(i+j) \quad (21)$$

In step S54, the index i is incremented by 1, and the process returns to step S52. In step S55, the following equations are calculated, and the resultant value of aX is employed as the average value of the signal in the first interval, and the value of aY is employed as the average value of the signal in the second, $$aX=aX/j \quad (22)$$

$$aY=aY/j \quad (23)$$

The process is then ended.

In the calculation of the similar-waveform length W described above, any interval length j, for which the correlation coefficient between the first interval and the second interval is negative for both L and R channels, cannot be a candidate for the similar-waveform length W. Thus, even when the function D(j) indicating the similarity has a small value for a particular interval length j, if the correlation coefficient between the first interval and the second interval is negative for both R and L channels, the interval length j is not employed as the similar-waveform length W. Thus, in the expanding/compressing process described above with reference to FIGS. 9 to 11, it is possible to prevent an unnatural sound from occurring, which would otherwise occur due to cancellation in the process of producing connection waveforms. Thus, it is possible to achieve a high-quality sound in the speech speed conversion.

FIGS. 12 to 16 illustrate examples in which the function D(j) indicating the similarity has a small value although the correlation coefficient between the signal in the first interval and the signal in the second interval. Note that in these examples, it is assumed that the signals are monaural.

Figure 12:
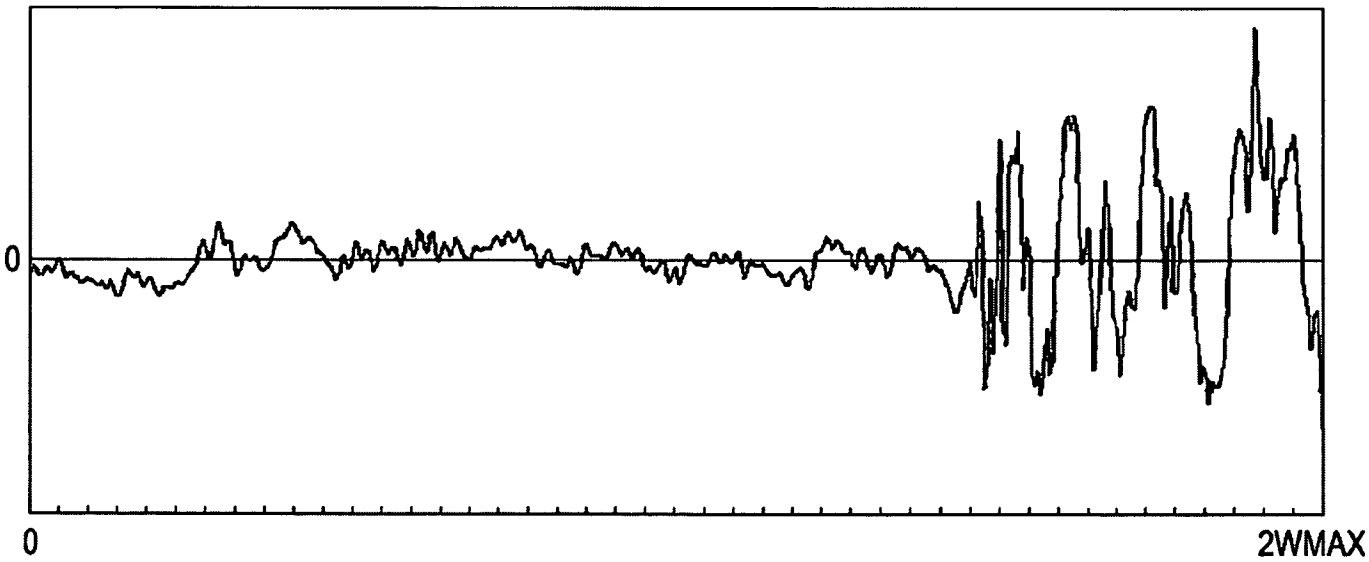
FIG. 12 illustrates an example of an input waveform.
Figures 13A, 13B:
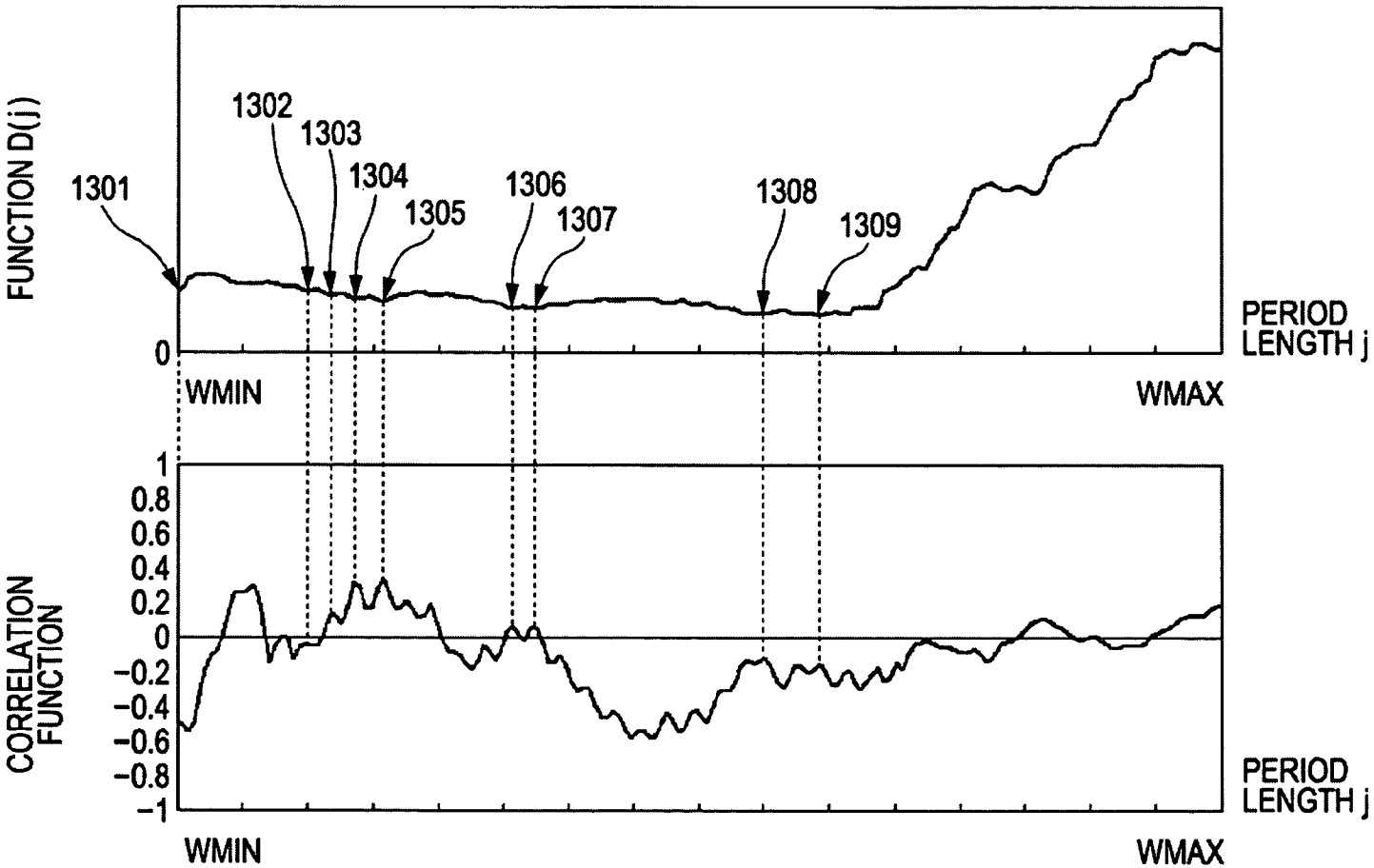
FIGS. 13A and 13B are graphs indicating a function D(j) and a correlation coefficient in an interval j.

FIG. 12 illustrates an example of an input waveform including 2WMAX samples. FIG. 13A is a graph of the function D(j) determined for the start point set at the beginning of the input waveform shown in FIG. 12. FIG. 13B is a graph of the correlation coefficient between the first interval and the second interval for each interval length j in the employed in the calculation of the value of the function D(j) shown in FIG. 13A. In the process of determining the similar-waveform length shown in FIG. 30, j is varied from WMIN toward WMAX. In the course of variation of j, the function D(j) has a first minimum value at a point 1301 shown in FIG. 13A. The value of the function D(j) at this point is substituted into the variable MIN, and j is substituted into the variable W. The function D(j) has a next minimum value at a point 1302. The value of the function D(j) at this point is substituted into the variable MIN, and j is substituted into the variable W. Similarly, the function D(j) sequentially has minimum values at points 1303, 1304, 1305, 106, 107, 1308, and 1309, and the values of the function D(j) at these points are substituted into the variable MIN, and j is substituted into the variable W. In a range after the point 1309, the function D(j) does not have a value smaller than that at the point 1309, and thus it is determined that the function D(j) has a minimum value in the whole range at the point 1309.

Figure 14:
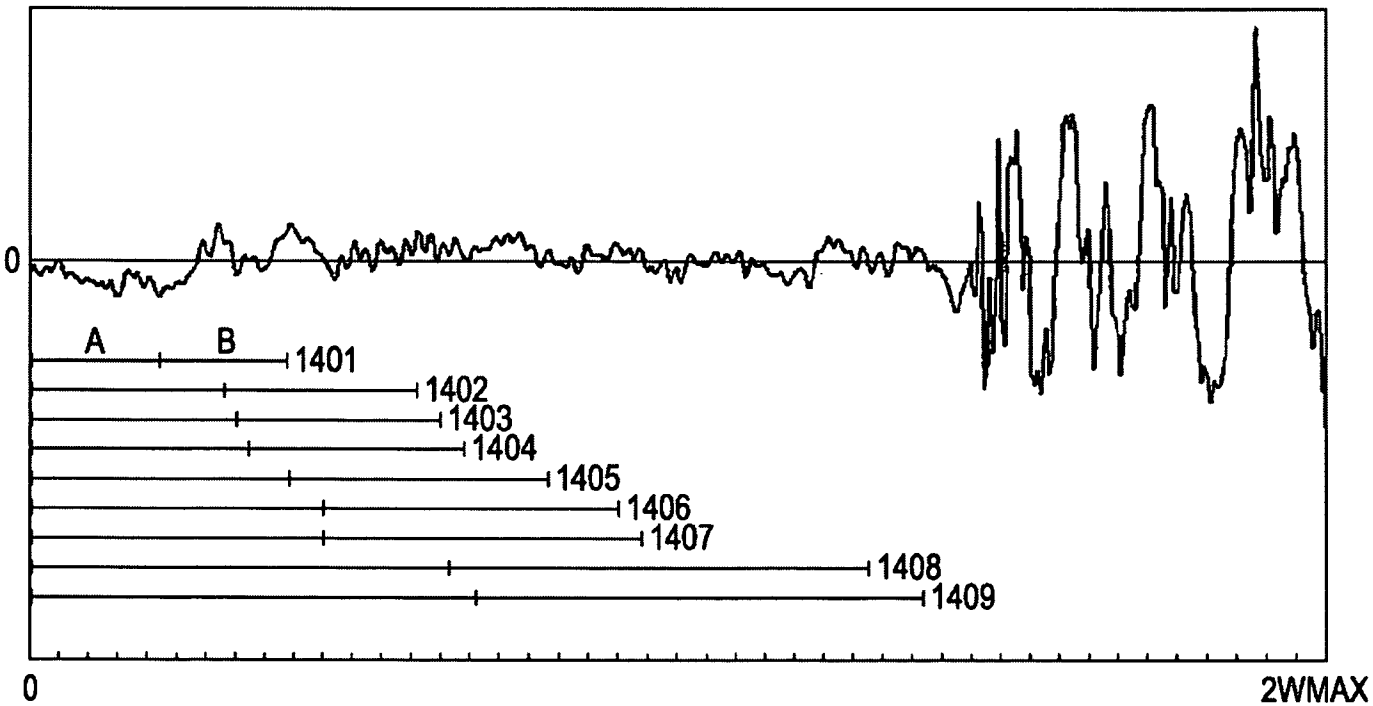
FIG. 14 illustrates a first interval A and a second interval for various lengths.
Figure 29:
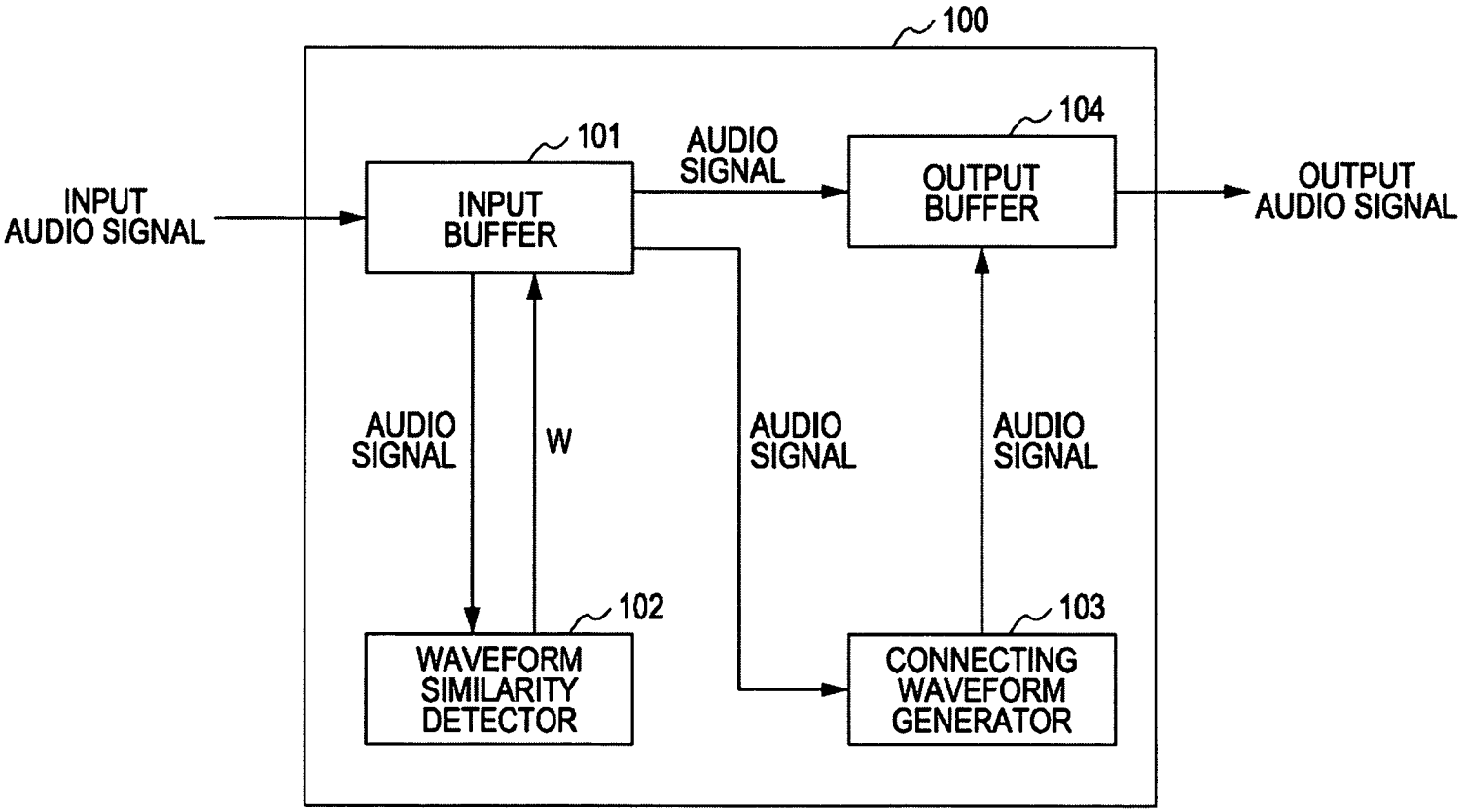
FIG. 29 is a block diagram illustrating an example of a configuration of a speech speed conversion apparatus using a PICOLA algorithm.

FIG. 14 illustrates the first interval and the second interval for various points 1301 to 1309. At the point 1301, a first interval and a second interval are set in an interval 1401. At the point 1302, a first interval and a second interval are set in an interval 1402. Similarly, at respective points 1303 to 1309, a first interval and a second interval are set in intervals 1403 to 1409. For example, the connection waveform generator 103 of the monaural signal expanding/compressing apparatus shown in FIG. 29 generates a connection waveform using the first interval A and the second interval B in the interval 1409.

At the point 1309, as can be seen from the graph shown in FIG. 13B, the correlation coefficient between the first interval and the second interval is negative. When the correlation coefficient between the first and second intervals is negative, degradation in sound quality can occur during the cross-fading process performed by the connection waveform generator, as described below with reference to FIGS. 15 and 16. In general, an acoustic signal includes various sounds simultaneously generated by various instruments. In examples shown in FIGS. 15A and 16A, a waveform with a small amplitude represented by a solid curve is superimposed on a waveform with a larger amplitude represented by a dotted curve.

Figures 15A, 15B, 15C:
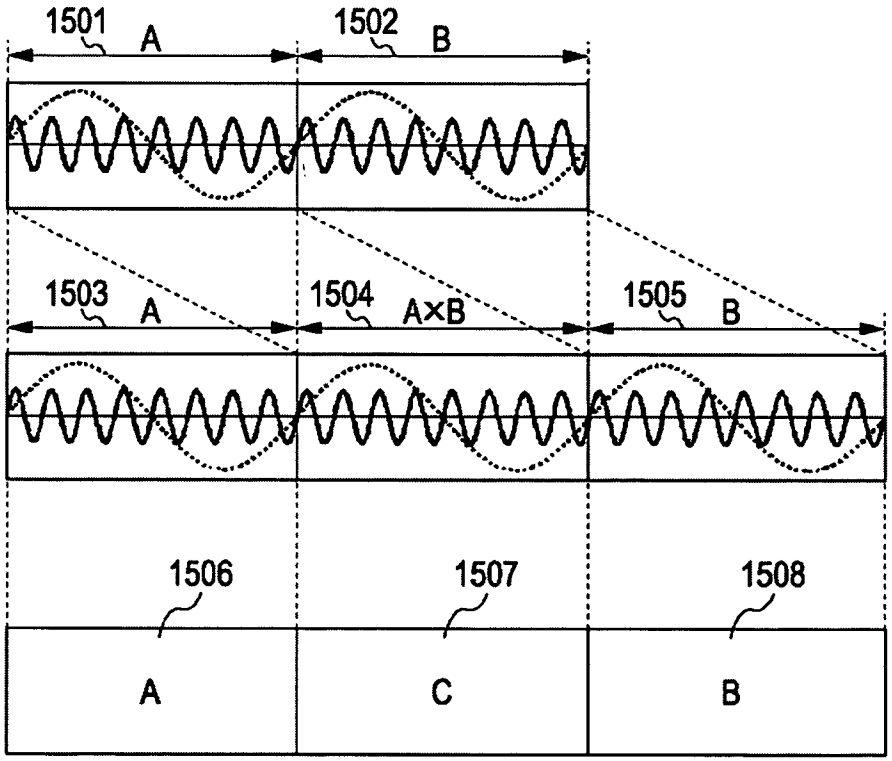
FIGS. 15A to 15C illustrate an example of a manner in which an expanded waveform is produced from waveforms in two intervals with the same phase.

FIGS. 15A and 15B illustrate a manner of expanding a waveform including an interval A and an interval B shown in FIG. 15A to a waveform shown in FIG. 15B. In FIG. 15A, the waveform represented by the solid curve has an equal phase between the interval A and the interval B. In a case where the original waveform shown in FIG. 15A is expanded by a factor of 1.5, the interval A (1501) in the waveform shown in FIG. 15A is copied into an interval A (1503) in the expanded waveform (FIG. 15B), and the cross-fade waveform generated from the interval A (1501) and the interval B (1502) of the waveform shown in FIG. 15A is copied into an interval A×B (1504) in the expanded waveform (FIG. 15B). Finally, the interval B (1502) of the original waveform (FIG. 15A) is copied into an interval B (1505) in the expanded waveform (FIG. 15B). Herein, the envelope of the expanded waveform represented by the solid curve in FIG. 15B is schematically represented as shown in FIG. 15C.

Figures 16A, 16B, 16C:
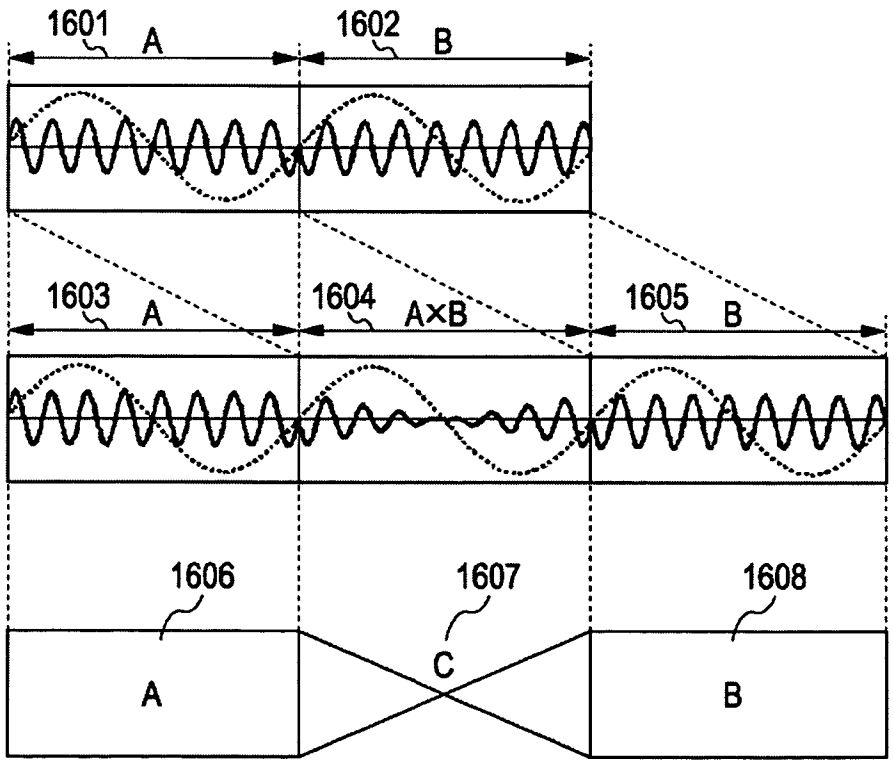
FIGS. 16A to 16C illustrate an example of a manner in which an expanded waveform is produced from waveforms in two intervals with opposite phases.

FIGS. 16A and 16B illustrate a manner of expanding a waveform including an interval A and an interval B shown in FIG. 16A to a waveform shown in FIG. 16B. In the waveform represented by the solid curve in FIG. 16A, the phase in the interval B is opposite to the phase in the interval A. In a case where the original waveform shown in FIG. 16A is expanded by a factor of 1.5, the interval A (1601) in the waveform shown in FIG. 16A is copied into an interval A (1603) in the expanded waveform (FIG. 16B), and the cross-fade waveform generated from the interval A (1601) and the interval B (1602) of the waveform shown in FIG. 16A is copied into an interval A×B (1604) in the expanded waveform (FIG. 16B). Finally, the interval B (1602) of the original waveform (FIG. 16A) is copied into an interval B (1605) in the expanded waveform (FIG. 163). Herein, the envelope of the expanded waveform represented by the solid curve in FIG. 16B is schematically represented as shown in FIG. 16C.

In practice, general acoustic signals do not include a waveform similar to the waveform represented by the solid curve in FIG. 16A. However, a waveform having a nearly opposite phase between an interval A and an interval B is often observed in practical acoustic signals. As can be easily understood from comparison between the expanded waveform shown in FIG. 15B and the expanded waveform shown in FIG. 16B, the amplitude of the cross-fade waveform greatly varies depending on the correlation between two original waveforms cross-faded. In particular, when the correlation coefficient is negative (as with the case in FIG. 16), great attenuation in amplitude occurs in the cross-fade waveform. If such attenuation frequently occurs, an unnatural sound similar to a howl occurs.

When the function D(j) has a minimum value at a particular point, if the correlation coefficient is negative as with the point 1309 shown in FIGS. 13A and 13B, there is a possibility that an unnatural sound similar to a howl occurs in a cross-fade waveform produced in the connection waveform generation process, as described above with reference to FIGS. 16A to 16C. The above-described problem can be avoided by determining the optimum similar-waveform length such that a point such as a point 1307 in the example shown in FIGS. 13A and 13B is selected at which the function D(j) has a minimum value and the correlation coefficient is not negative.

That is, in the method described above with reference to FIGS. 9 and 10, the correlation coefficient between the first and second intervals of the stereo signal is calculated, and if it is determined in step S39 that the correlation coefficient is negative for both channels, the value of j is excluded from candidates for the similar-waveform length.

By excluding the value of j, for which the correlation coefficient is negative for both channels, from candidates for the similar-waveform length as described above, it becomes possible to prevent attenuation of the amplitude of the cross-face waveform from occurring in the cross-fading process in the connection waveform generation process, thereby preventing an unnatural sound such as a howl from occurring. More specifically, in the calculation of the similarity between two intervals of an input audio signal, an interval length for which the correlation coefficient between two intervals is equal to or greater than a threshold value for one or more channels is selected as a candidate, the similarity is calculated separately for each channel, and then an optimum value is determined based on the similarity calculated for each channel. This makes it possible to correctly detect a similar-waveform length even for a stereo signal having a phase difference between channels without being influenced by the phase difference.

Figure 17:
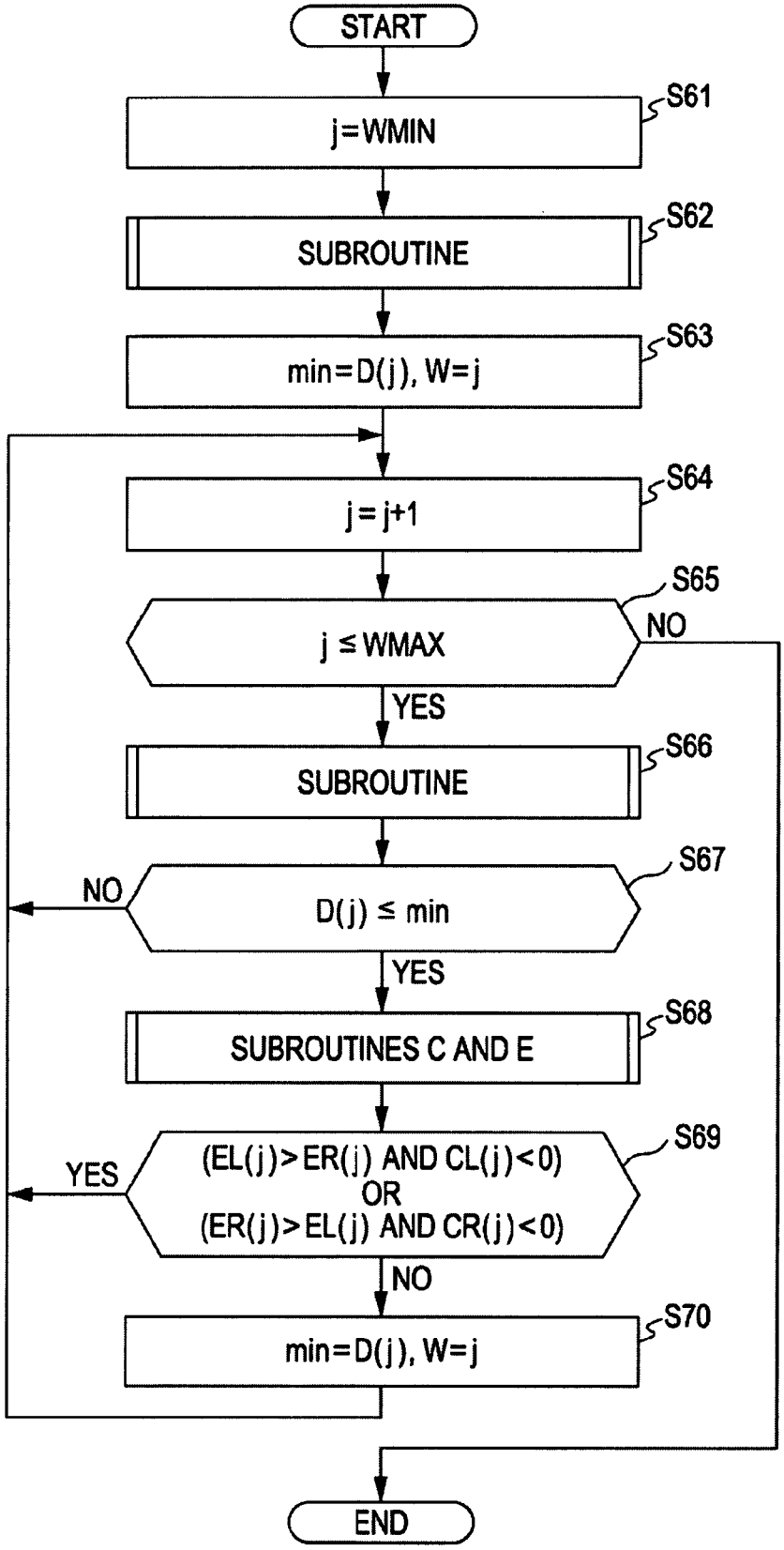
FIG. 17 is a flow chart illustrating a process performed by a similar-waveform length detector.

FIG. 17 is a flow chart illustrating another example of a process performed by the similar-waveform length detector 12. The process shown in this flow chart of FIG. 17 includes an additional step of determining whether an interval length j is employed or not as the similar-waveform length, in accordance with the correlation between first and second intervals of a signal and the correlation of energy between right and left channels. Even when the function D(j) indicating the measure of the similarity has a small value for an interval length j, if the correlation coefficient of the signal between the first interval and the second interval is negative for a channel having greater energy, a great cancellation can occur in the production of the connection waveform, which can cause an unnatural sound to occur. Note that the greater the energy, the greater attenuation can occur. This problem can be avoided by employing the process shown in the flow chart of FIG. 17.

Figure 18:
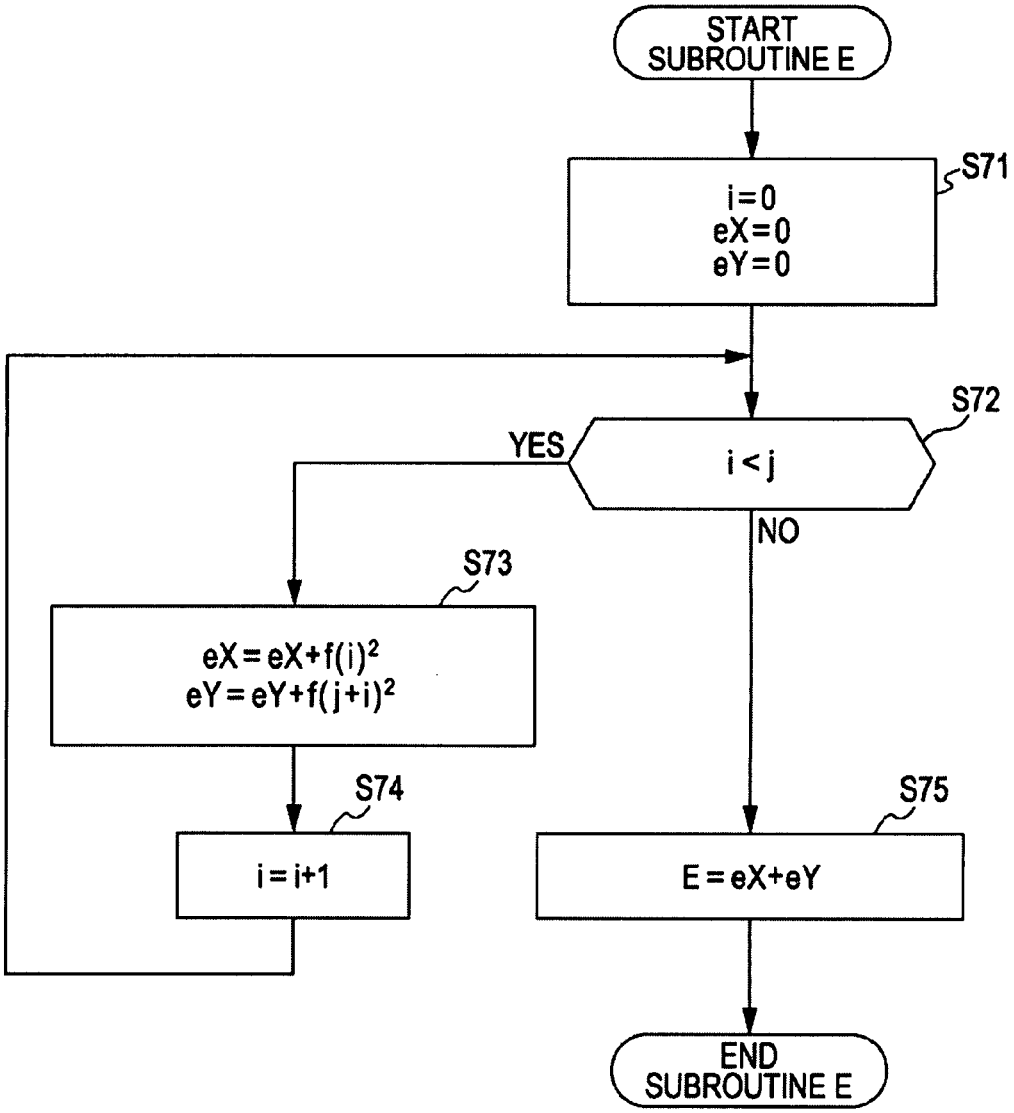
FIG. 18 is a flow chart illustrating a subroutine E of determining energy of a signal.

In step S61, an index j is set to an initial value of WMIN. In step S62, a subroutine shown in FIG. 3 is executed to calculate a function D(j). In step S63, the value of the function D(j) determined by executing the subroutine is substituted into a variable MIN, and the index j is substituted into W. In step S64, the index j is incremented by 1. In step S65, a determination is made as to whether the index j is equal to or smaller than WMAX. If the index j is equal to or smaller than WMAX, the process proceeds to step S66. However, if the index j is greater than WMAX, the process is ended. The value of the variable W obtained at the end of the process indicates the index j for which the function D(j) has a minimum value and the requirements are satisfied in terms of the correlation between the first interval and the second interval of the signal and in terms of the energy of right and left channels. That is, this value gives the similar-waveform length, and the variable MIN in this state indicates the minimum value of the function D(j). In step S66, the subroutine shown in FIG. 3 is executed to determine the value of the function D(j) for a new index j. In step S67, it is determined whether the value of the function D(j) determined in step S66 is equal to or smaller than MIN. If the determined value is equal to or smaller than MIN, the process proceeds to step S68, but otherwise the process returns to step S64. In step S68, the subroutine C shown in FIG. 10 and a subroutine shown in FIG. 18 are executed for each of the L channel and the R channel. In the subroutine C, the correlation coefficient between the first interval and the second interval is determined. The correlation coefficient determined in the above process is denoted as CL(j) for the L channel and CR(j) for the R channel. In the subroutine E, energy of the signal is determined. The energy determined for the L channel is denoted as EL(j), and the energy determined for the R channel is denoted as ER(j). In step S69, correlation coefficients CL(j) and CR(j), and the energy EL(j) and ER(j) determined in step S68 are examined to determine whether the following condition is satisfied.

$$((EL(j)>ER(j)) \text{ and } (CL(j)<0)) \tag{24}$$

or $$((ER(j)>EL(j)) \text{ and } (CR(j)<0)) \tag{25}$$

If the above condition is satisfied, that is, if the correlation coefficient is negative for a channel with greater energy, the process returns to step S64, but otherwise the process proceeds to step S70. In step S70, the value of the function D(j) determined is substituted into the variable MIN, and the index j is substituted into W.

The details of the subroutine E are described below with reference to the flow chart shown in FIG. 18. In step S71, an index i, a variable eX, and a variable eY are reset to 0. In step S72, it is determined whether the index i is smaller than the index j. If so the process proceeds to step S73, but otherwise the process proceeds to step S75. In step S73, the energy eX of the signal in the first interval and the energy eY of the signal in the second interval are determined in accordance with the following equations.

$$eX=eX+f(i)^2 \tag{26}$$

$$eY=eY+f(i+j)^2 \tag{27}$$

In step S74, the index i is incremented by 1, and the process returns to step S72. In step S75, the sum of the energy eX of the signal in the first interval and the energy eY of the signal in the second interval is calculated to determine the total energy of the first and second intervals, and the subroutine E is then ended.

$$E=eX+eY \tag{28}$$

The process described above is performed separately for L and R channels.

in the method described above with reference to FIGS. 17 and 18, if the correlation coefficient of the signal between the first interval and the second interval is negative for a channel having greater energy, the interval length j is excluded from candidates for the similar-waveform length W. This prevents an unnatural sound similar to a howl from occurring due to a great cancellation occurring in the production of the connection waveform. Thus, even when the function D(j) indicating the similarity has a small value for a particular interval length j, if the correlation coefficient of the signal between the first interval and the second interval is negative for a channel having greater energy, the interval length j is not employed as the similar-waveform length W. Thus, use of the method described above with reference to FIGS. 17 and 18 makes it possible to achieve a high-quality sound in the speech speed conversion. More specifically, in the calculation of the similarity between two intervals of an input audio signal, an interval length for which the correlation coefficient between two intervals is equal to or greater than a threshold value for a channel having greater energy is selected as a candidate, the similarity is calculated separately for each channel, and then an optimum value is determined based on the similarity calculated for each channel. This makes it possible to correctly detect a similar-waveform length even for a stereo signal having a phase difference between channels without being influenced by the phase difference.

Figure 19:
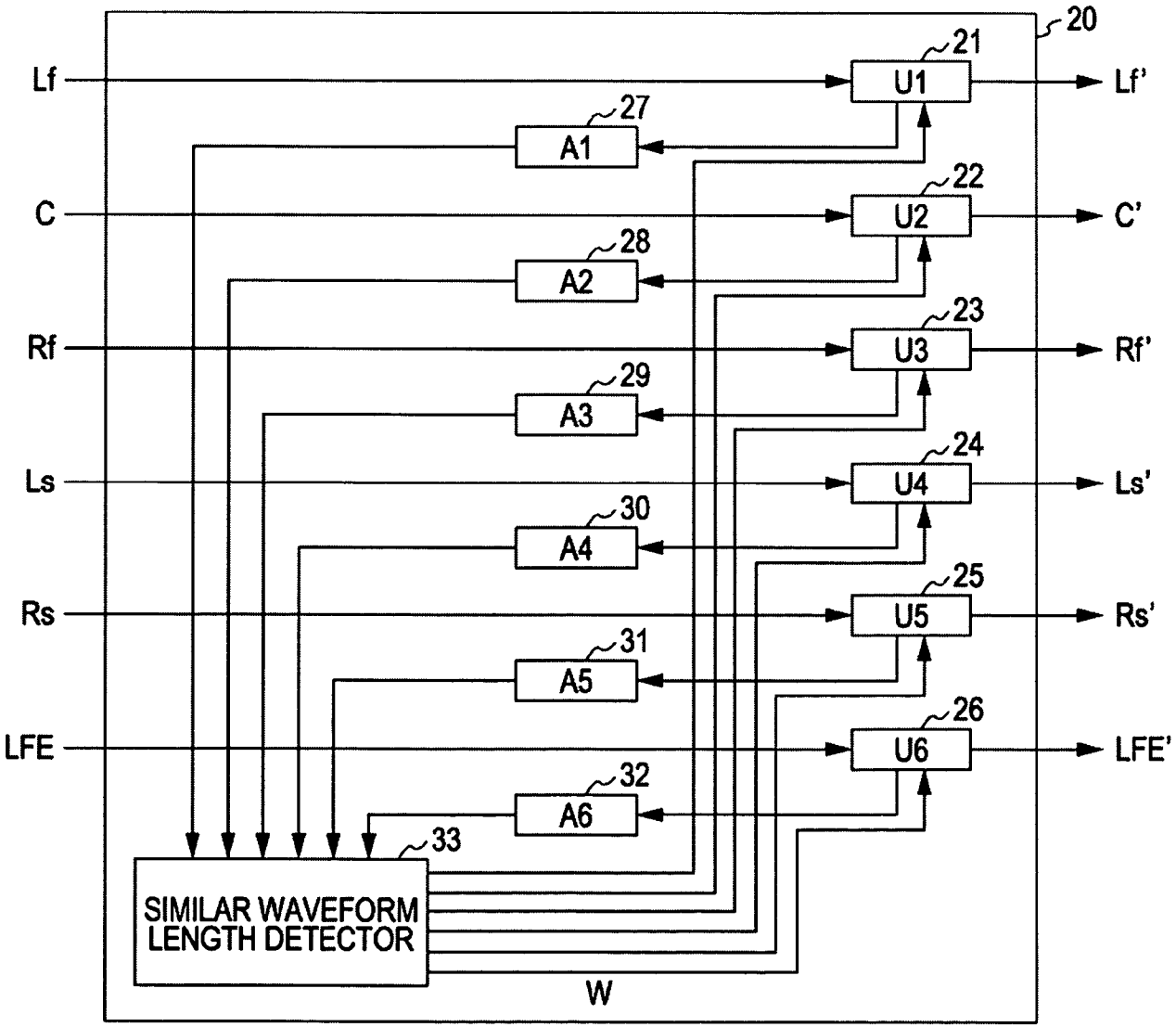
FIG. 19 is a block diagram illustrating an example of an audio signal expanding/compressing apparatus adapted to expand/compress a multichannel signal.

FIG. 19 is a block diagram illustrating an example of an audio signal expanding/compressing apparatus adapted to expand/compress a multichannel signal. The multichannel signal includes an Lf channel signal (front left channel signal), a C channel signal (center channel signal), an Rf channel signal (front right channel signal), an Ls channel signal (surround left channel signal), an Rs channel signal (surround right channel signal), and an LFE channel signal (low frequency effect channel signal).

The audio signal expanding/compressing apparatus 20 includes a speech speed conversion unit (U1) 21 adapted to expand/compress the Lf channel signal, a speech speed conversion unit (U2) 22 adapted to expand/compress the C channel signal, a speech speed conversion unit (U3) 23 adapted to expand/compress the Rf channel signal, a speech speed conversion unit (U4) 24 adapted to expand/compress the Ls channel signal, a speech speed conversion unit (U5) 25 adapted to expand/compress the Rs channel signal, a speech speed conversion unit (U6) 26 adapted to expand/compress the LFE channel signal, an amplifiers (A1 to A6) 27 to 32 adapted to weight the audio signals output from the respective speech speed conversion units 21 to 26, and a similar-waveform length detector 33 adapted to detect a similar-waveform length command for all channels from the audio signals weighted by the amplifiers (A1 to A6) 27 to 32.

When the input audio signal to be processed is given, the Lf channel signal is buffered in the speech speed conversion unit (U1) 21, the C channel signal is buffered in the speech speed conversion unit (U2) 22, the Rf channel signal is buffered in the speech speed conversion unit (U3) 23, the Ls channel signal is buffered in the speech speed conversion unit (U4) 24, the Rs channel signal is buffered in the speech speed conversion unit (U5) 25, and the LFE channel signal is buffered in the speech speed conversion unit (U6) 26.

Figure 20:
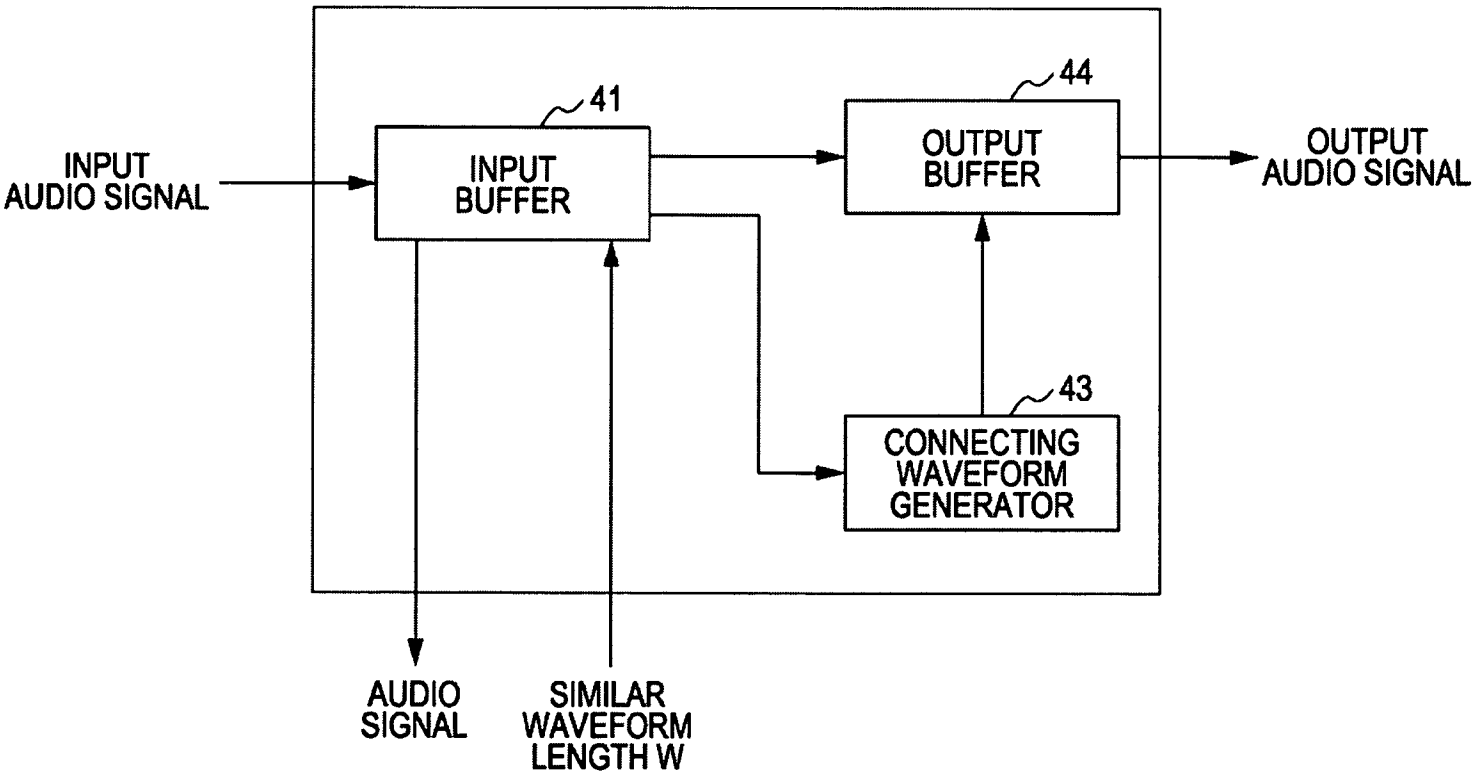
FIG. 20 is a block diagram illustrating an example of a configuration of a speech speed conversion unit.

Each of the speech speed conversion units 21 to 26 is configured as shown in FIG. 20. That is, each speech speed conversion unit includes an input buffer 41, a connection waveform generator 43, and an output buffer 44. The input buffer 41 serves to buffer the input audio signal. The connection waveform generator 43 is adapted to generate a connection waveform including W samples by cross-fading the audio signal including 2W samples supplied from the input buffer 41 in accordance with the similar-waveform length w detected by the similar-waveform length detector 33. The output buffer 44 is adapted to generate an output audio signal using the input audio signal and the connection waveform input in accordance with the speech speed conversion ratio R.

Each of the amplifiers (A1 to A6) 27 to 32 serves to adjust the amplitude of the signal of the corresponding channel. For example, when all channels are equally used in detection of the similar-waveform length, the gains of the amplifiers (A1 to A6) 27 to 32 are set at ratios according to (29) shown below, but when the LFE channel is not used, the gains of the amplifiers (A1 to A6) 27 to 32 are set at ratios according to (30) shown below.

$$Lf:C:Rf:Ls:Rs:LFE=1:1:1:1:1:1 \tag{29}$$

$$Lf:C:Rf:Ls:Rs:LFE=1:1:1:1:1:0 \tag{30}$$

The LFE channel is for signal components in a very low-frequency range, and it is not necessarily suitable to use the LFE channel in detecting the similar-waveform length. It is possible to prevent the LFE channel from influencing the detection of the similar-waveform length by setting the weighting factor for the LFE channel to 0 as (30).

To reduce the weighting factor for the surround channel used for sound effects in addition to setting the weighting factor for the LFE channel to 0, the weighting factors may be set as (31) shown below.

$$Lf:C:Rf:Ls:Rs:LFE=1:1:1:0.5:0.5:0 \tag{31}$$

The similar-waveform length detector 33 determines the sum of squares of differences (mean square error) separately for the audio signals weighted by the amplifiers (A1 to A6) 27 to 32.

$$DLf(j)=(1/j)\Sigma\{fLf(i)-fLf(j+i)\}^2 \tag{32}$$

$$DC(j)=(1/j)\Sigma\{fCf(i)-fCf(j+i)\}^2 \tag{33}$$

$$DRf(j)=(1/j)\Sigma\{fRf(i)-fRf(j+i)\}^2 \tag{34}$$

$$DLs(j)=(1/j)\Sigma\{fLs(i)-fLs(j+i)\}^2 \tag{35}$$

$$DRs(j)=(1/j)\Sigma\{fRf(i)-fRf(j+i)\}^2 \tag{36}$$

$$DLFE(j)=(1/j)\Sigma\{fLFE(i)-fLFE(j+i)\}^2 \tag{37}$$

where fLf denotes a sample value of the Lf channel, fCf denotes a sample value of the C channel, fRf denotes a sample value of the Rf channel, fLs denotes a sample value of the Ls channel, fRs denotes a sample value of the Rs channel, and fLFE denotes a sample value of the FLE channel. DLf(j) denotes the sum of squares of differences (mean square error) of sample values between two waveforms (intervals) of the Lf channel. DC(j), DRf(j), DLs(j), DRs(j), and DLFE(j) respectively denote similar values of the corresponding channels.

Thereafter, the sum of DLf(j), DC(j), DRf(j), DLs(j), DRs(j), and DLFE(j) is calculated, and the result is employed as the value of the function D(j).

$$D(j)=DLf(j)+DC(j)+DRf(j)+DLs(j)+DRs(j)+DLFE(j) \tag{38}$$

The value of j for which the function D(j) has a minimum value is determined, and w is set to j (W=j). The similar-waveform length W given by j is used in common as the similar-waveform length W for all channels of a multichannel signal. The similar-waveform length W determined by the similar-waveform length detector 33 is supplied to speech speed conversion units 21 to 26 of respective channels so that the similar-waveform length W is used in a buffering operation or in producing a connection waveform. The audio signals subjected to the speech speed conversion performed by the respective speech speed conversion units 21 to 26 are output, as output audio signals, from the speech speed conversion apparatus 20.

As described above, by adjusting the gains of the respective channels to weight the channels used in the detection of the similar-waveform length before the similarity between two intervals of the input audio signal is calculated, it becomes possible to more precisely detect the similar-waveform length even when there is a phase difference among channels without being influenced by the phase difference.

FIG. 20 is a block diagram illustrating an example of a configuration of one of the speech speed conversion units 21 to 26 shown in FIG. 19. The speech speed conversion unit includes an input buffer 41, a connection waveform generator 43, and an output buffer 44, which are similar to the input buffer L11, the connection waveform generator L13, and the output buffer L14 shown in FIG. 1. When an audio signal to be processed is input, the input audio signal is first stored in then input buffer 41. In order to detect the similar-waveform length W from the audio signal stored in the input buffer 41, the input buffer 41 supplies the audio signal to the similar-waveform length detector 33 shown in FIG. 19. The detected similar-waveform length W is returned from the similar-waveform length detector 33 to the input buffer 41. The input buffer 41 then supplies 2W samples of the audio signal to the connection waveform generator 43. The connection waveform generator 43 converts the received 2W samples of the audio signal into W samples of audio signal by performing a cross-fading process. The audio signal stored in the input buffer 41 and the audio signal produced by the connection waveform generator 43 are supplied to the output buffer 44 in accordance with a speech speed conversion ratio R. An audio signal is generated by the output buffer 44 from the audio signals received from the input buffer 41 and the connection waveform generator 43 and output, as an output audio signal, from the speech speed conversion units 21 to 26.

Figure 21:
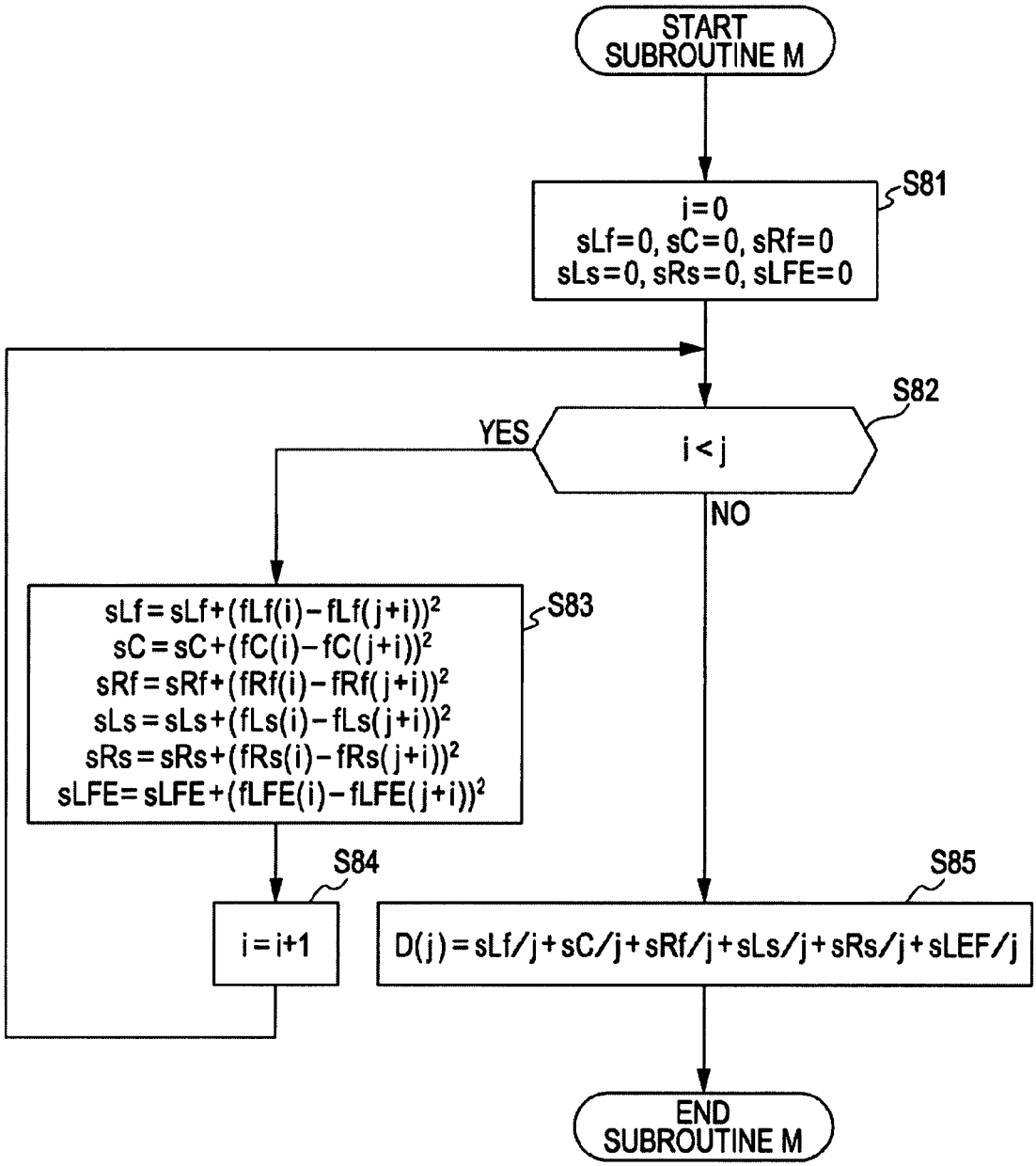
FIG. 21 is a flow chart illustrating a subroutine of calculating a function D(j)
Figures 22A, 22B, 22C, 22D:
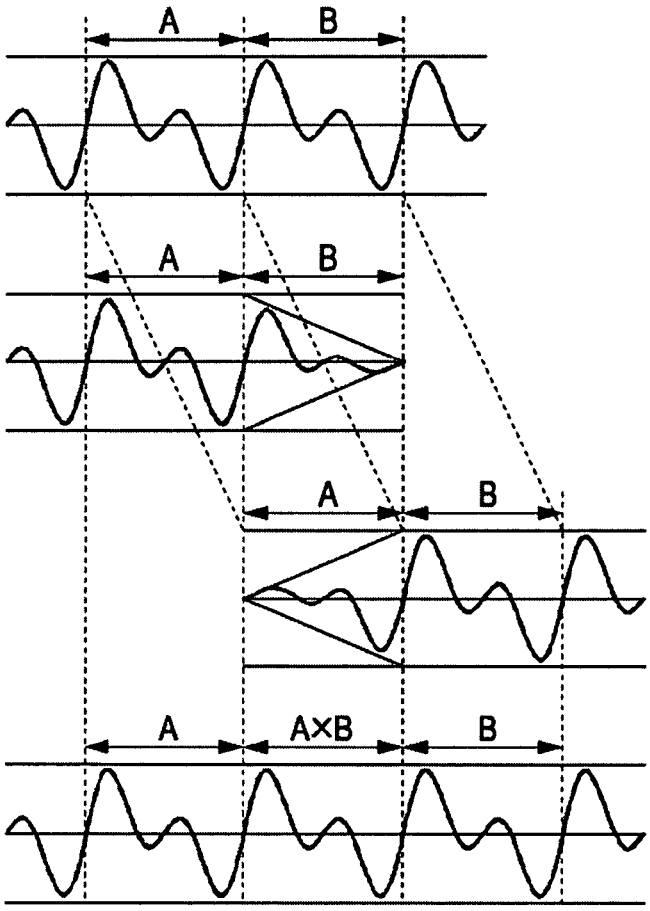
FIGS. 22A to 22D illustrate an example of a process of expanding an original waveform using a PICOLA algorithm.
Figure 23A:
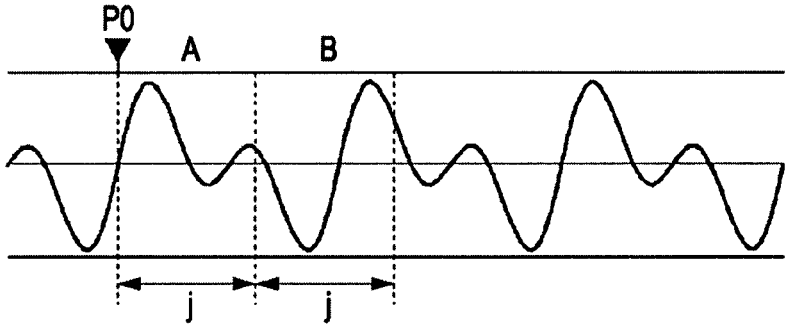
FIGS. 23A to 23C illustrate of a manner of detecting the length W of the intervals A and B which are similar in waveform to each other.
Figure 23B:
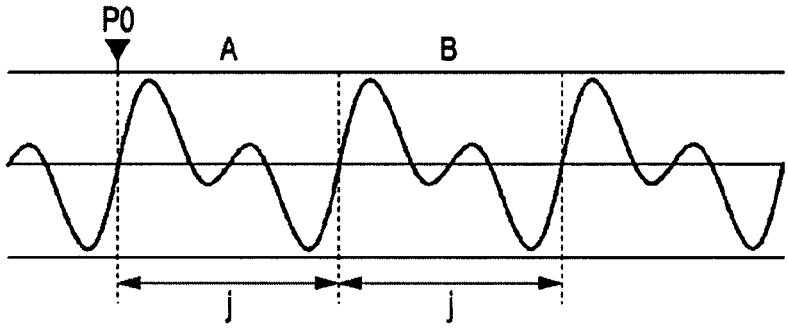
Figure 23C:
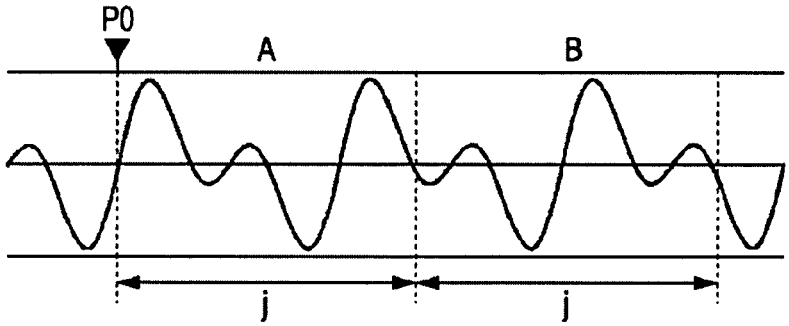
Figures 24A, 24B:
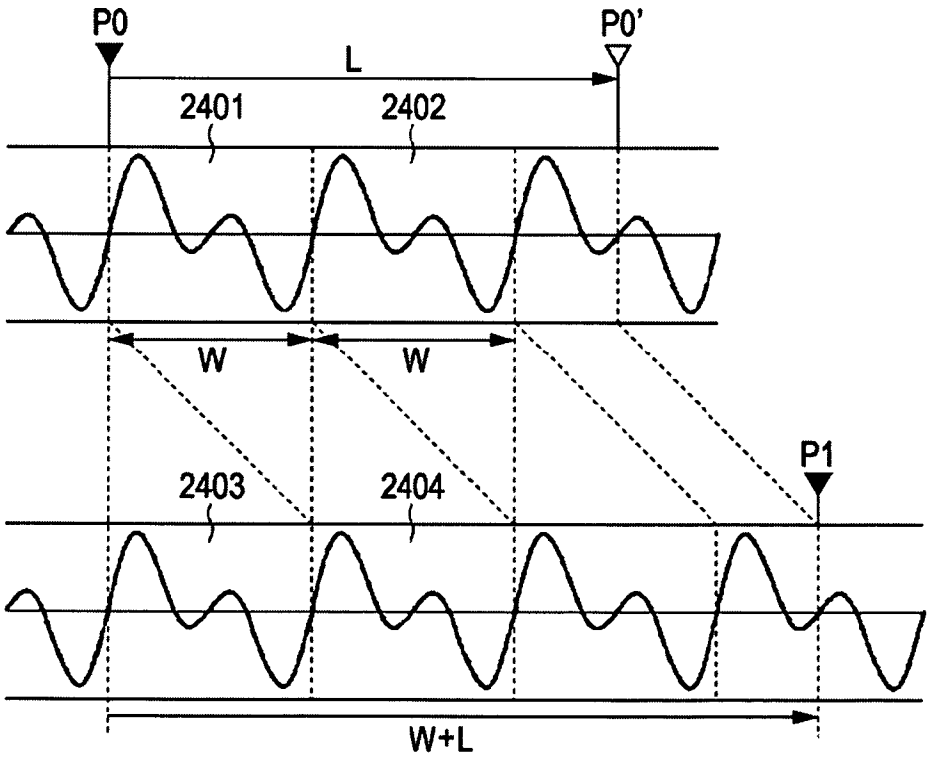
FIG. 24 illustrates a manner of expanding a waveform to an arbitrary length.
Figures 25A, 25B, 25C, 25D:
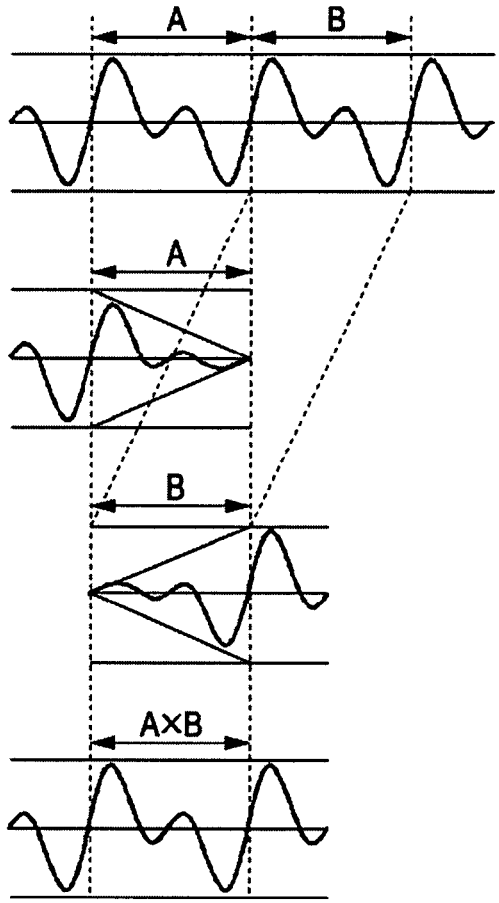
FIGS. 25A to 25D illustrate an example of a manner of compressing an original waveform using a PICOLA algorithm.
Figures 26A, 26B:
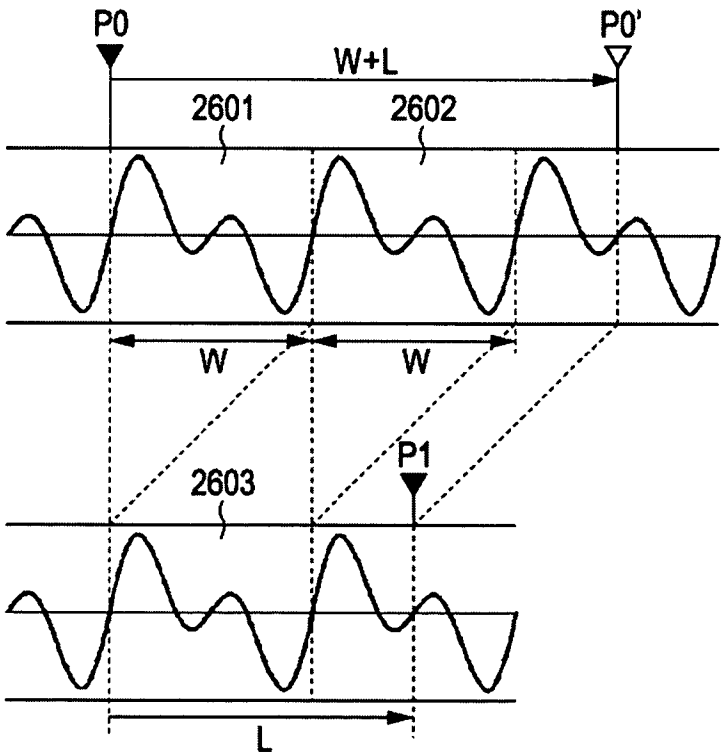
FIGS. 26A and 26B illustrate an example of a manner of compressing a waveform to an arbitrary length.
Figure 27:
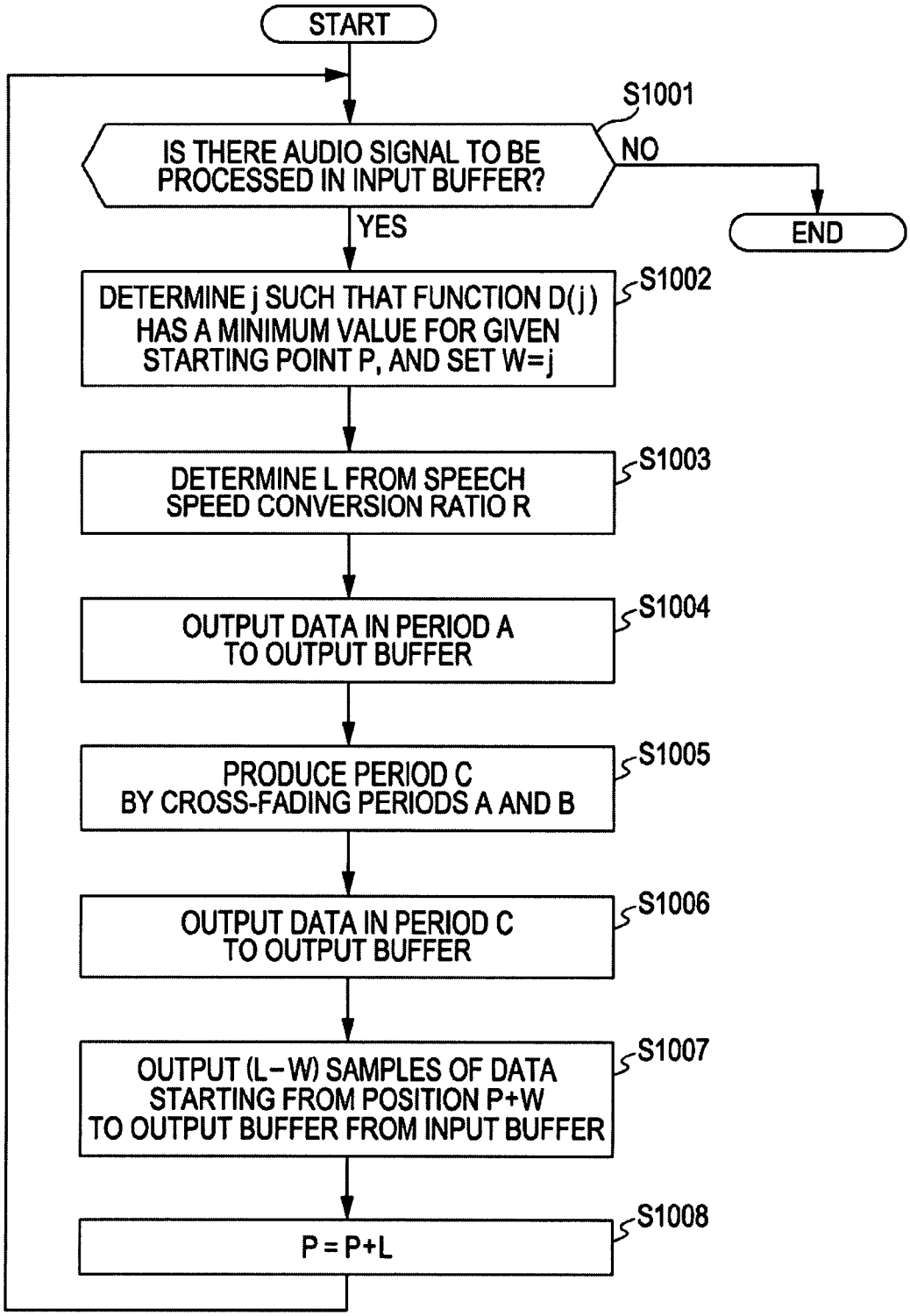
FIG. 27 is a flow chart illustrating a waveform expansion process according to a PICOLA algorithm.
Figure 28:
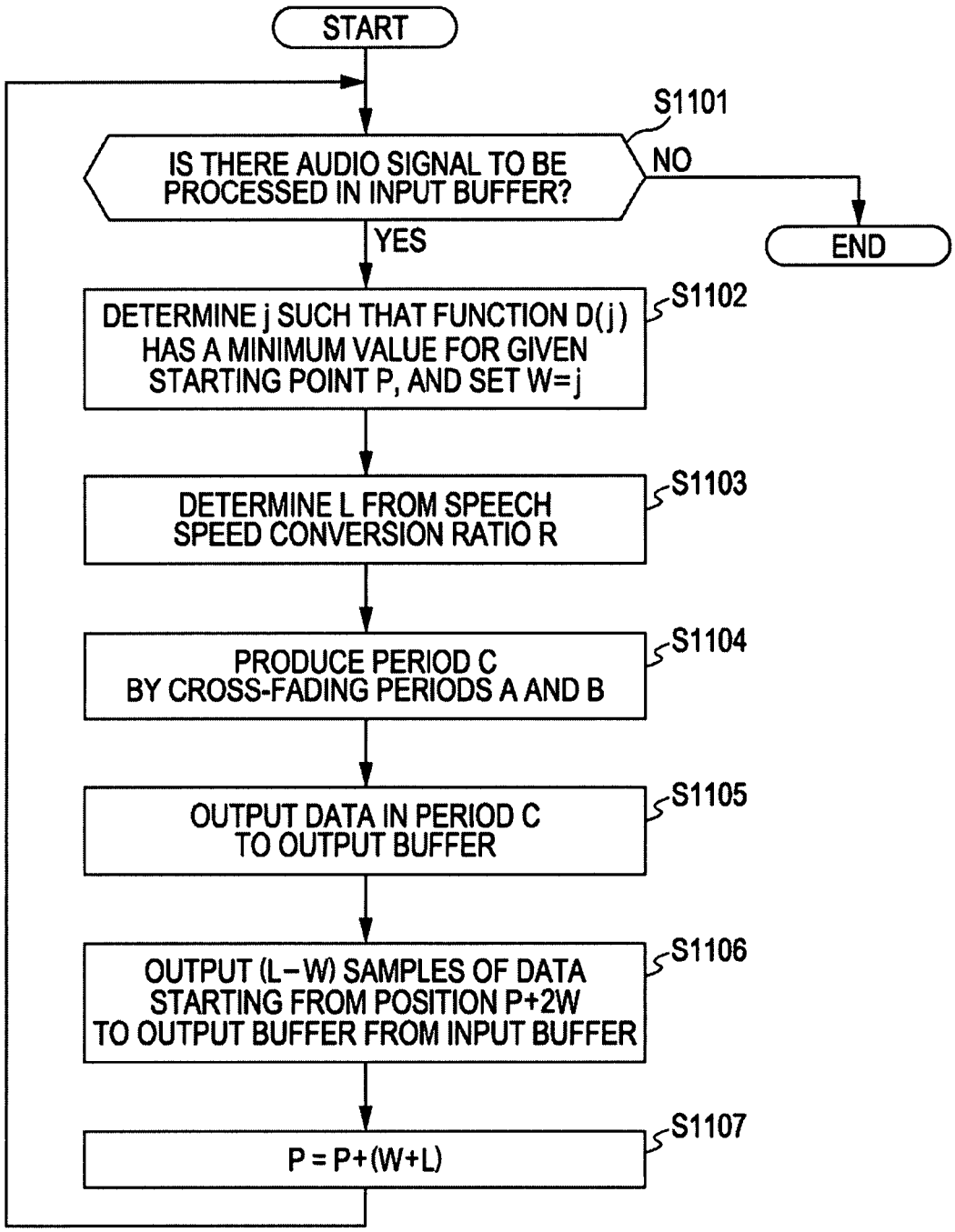
FIG. 28 is a flow chart illustrating a waveform compression process according to a PICOLA algorithm.

The similar-waveform length detector 33 shown in FIG. 19 operates in a similar manner as described above with reference to the flow chart shown in FIG. 2 except that the subroutine is performed as shown in FIG. 21. That is, the subroutine of calculating the value of function D(j) indicating the similarity among a plurality of waveforms is replaced from that shown in FIG. 3 to that shown in FIG. 21.

The subroutine shown in FIG. 21 is executed as follows. In step S81, an index i is reset to 0, and variables sLf, sC, sRf, sLs, sRs, and sLFE are also reset to 0. In step S82, it is determined whether the index i is smaller than the index j. If so the process proceeds to step S83, but otherwise the process proceeds to step S85. In step S83, according to equations (32) to (37), the square of the difference between signals of the L channel is determined and the result is added to the variable sLf, the square of the difference between signals of the C channel is determined and the result is added to the variable sC, the square of the difference between signals of the Rf channel is determined and the result is added to the variable sRf, the square of the difference between signals of the Ls channel is determined and the result is added to the variable sLs, the square of the difference between signals of the Rs channel is determined and the result is added to the variable sRs, and the square of the difference between signals of the LFE channel is determined and the result is added to the variable sLFE. In step S84, the index i is incremented by 1, and the process returns to step S82. In step S85, the sum of the variables sLf, sC, sRf, sLs, sRs, and sLFE is calculated, and the sum is divided by the index j. The result is employed as the value of function D(j), and the subroutine is ended.

In the audio signal compression/expansion method described above with reference to FIGS. 19 to 21, the amplifiers (A1 to A6) 27 to 32 shown in FIG. 19 are used to adjust the weights of the respective channels of the multichannel signal. The weights may be adjusted differently. For example, the weighting factors are set to 1, and the respective variables (sLf, sC, sRf, sLs, sRs, and sLFE) may be multiplied by proper factors in step S85 in FIG. 21. In this case, the calculation of the sum in step S85 is modified as follows.

$$\begin{aligned} D(j) = {} & C1 \times sLf / j + \\ & C2 \times sC / j + \\ & C3 \times sRf / j + \\ & C4 \times sLs / j + \\ & C5 \times sRs / j + \\ & C6 \times sLFE / j \end{aligned} \tag{39}$$

and equation (38) described above is modified as follows.

$$\begin{aligned} D(j) = {} & C1 \times DLf(j) + \\ & C2 \times DC(j) + \\ & C3 \times DRf(j) + \\ & C4 \times DLs(j) + \\ & C5 \times DRs(j) + \\ & C6 \times DLFE(j) \end{aligned} \tag{40}$$

where C1 to C6 are coefficients.

As described above, in the detection of the similar-waveform length of two intervals, the similarity of the respective channels may be weighted.

In the embodiments described above, the function D(j) of each channel is defined using the sum of squares of differences (mean square error). Alternatively, the sum of absolute values of differences may be used. Still alternatively, the function D(j) of each channel may be defined by the sum of correlation coefficients, and the value of j for which the sum of correlation coefficients has a maximum value is employed as W. That is, the function D(j) may be defined arbitrarily as long as the function D(j) correctly indicates the similarity between two waveforms.

In the case where the function D(j) of each channel is defined by the sum of absolute values of differences, equations (13) and (14) are replaced by the following equations.

$$DL(j)=(1/j)\Sigma|fL(i)-fL(j+1)|(i=0 \text{ to } j-1) \tag{41}$$

$$DR(j)=(1/j)\Sigma|fR(i)-fL(j+1)|(i=0 \text{ to } j-1) \tag{42}$$

In the case where the function D(j) of each channel is defined by the sum of correlation coefficients, equation (13) is replaced by the following equations.

$$aLX(j)=(1/j)EfL(i) \tag{43}$$

$$aLY(j)=(1/j)EfL(i+j) \tag{44}$$

$$sLX(j)=\Sigma\{fL(i)-aLX(j)\}^2 \tag{45}$$

$$sLY(j)=\Sigma\{fL(i+j)-aLY(j)\}^2 \tag{46}$$

$$sLXY(j)=\Sigma\{fL(i)-aLX(j)\}\{fL(i+j)-aLY(j)\} \tag{47}$$

$$DL(j)=sLXY(j)/\{sqrt(sLX(j))sqrt(sLY(j))\} \tag{48}$$

Equation (14) is also replaced in a similar manner.

In the case where the function D(j) of each channel is defined by the sum of correlation coefficients, each correlation coefficient is in the range from −1 to 1, and the similarity increases with increasing correlation coefficient. Therefore, the variable MIN in FIGS. 2, 9, and 17 is replaced by a variable MAX, and the condition checked in step S17 in FIG. 2, step S37 in FIG. 9, and step S67 in FIG. 17 is replaced by the following condition.

$$D(j) \leq \mathrm{MAX} \tag{49}$$

In the embodiment described above, the multichannel signal is assumed to be a 5.1 channel signal. However, the multichannel signal is not limited to the 5.1 channel signal, but the multichannel signal may include an arbitrary number of channels. For example, the multichannel signal may be a 7.1 channel signal or a 9.1 channel signal.

In the embodiments described above, the present invention is applied to the detection of the similar-waveform length using the PICOLA algorithm. However, the present invention is not limited to the PICOLA algorithm, but the present invention is applicable to other algorithms, such as an OLA (Over-Lap and Add) algorithm, to convert the speech speed in time domain by using In the PICOLA algorithm, if the sampling frequency is maintained constant, the speech speed is converted. However, if the sampling frequency is varied as the number of samples is varied, the pitch is shifted. This means that the present invention can be applied not only to the speech speed conversion but also to the pitch shifting. As a matter of course, the present invention can also be applied to waveform interpolation or extrapolation using the speech speed conversion.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal expanding/compressing apparatus adapted to expand or compress, in a time domain, a plurality of channels of audio signals by using similar waveforms, comprising:

cross-fading length detection means for detecting a cross-fading length for the audio signals, the cross-fading length detection means:

calculating by a computer, for each channel, a similarity of the audio signal between two successive intervals having a same length as a function of the length;

calculating an overall similarity based on a sum of the similarities of the channels; and detecting the cross-fading length on the basis of the overall similarity.

2. The audio signal expanding/compressing apparatus according to claim 1, further comprising amplitude adjustment means for adjusting the amplitude of the audio signal of each channel, wherein the cross-fading detection means calculates the similarity of the audio signal between two successive intervals for each channel on the basis of the audio signal subjected to the adjustment by the amplitude adjustment means.

3. The audio signal expanding/compressing apparatus according to claim 1, wherein the cross-fading length detection means adjusts the similarity of each channel and detects the cross-fading length on the basis of the adjusted similarity of each channel.

4. The audio signal expanding/compressing apparatus according to claim 1, wherein the cross-fading length detection means determines the similarity of the audio signal between two successive intervals on the basis of the mean square error of the signal of the two intervals, and determines the cross-fading length such that a smallest value of the sum of mean square errors of the respective channels is obtained for the determined cross-fading length.

5. The audio signal expanding/compressing apparatus according to claim 1, wherein the cross-fading length detection means determines the similarity of the audio signal between two successive intervals on the basis of the sum of absolute values of differences of the signal between the two intervals, and determines the cross-fading length such that a smallest value of the sum of the sums of absolute values of differences of the respective channels is obtained for the determined cross-fading length.

6. The audio signal expanding/compressing apparatus according to claim 1, wherein the cross-fading length detection means determines the similarity of the audio signal between two successive intervals on the basis of the correlation coefficient between the signals of the two intervals, and determines the cross-fading length such that a greatest value of the sum of the correlation coefficients of the respective channels is obtained for the determined cross-fading length.

7. The audio signal expanding/compressing apparatus according to claim 1, wherein the cross-fading length detection means selects two successive intervals in the audio signal from those for which the correlation coefficient is equal to or greater than a threshold value at least for one of channels.

8. The audio signal expanding/compressing apparatus according to claim 1, wherein the cross-fading length detection means determines whether or not the correlation coefficient of the audio signal between two successive intervals is equal to or greater than a threshold value for a channel having greatest energy, and, if not, discards the two successive intervals as a candidate for the cross-fading length.

9. A computer-implemented method of expanding or compressing, in a time domain, a plurality of channels of audio signals by using similar waveforms, comprising:

calculating, by a computer for each channel, a similarity of the audio signal between two successive intervals having a same length as a function of the length;

calculating an overall similarity based on a sum of the similarities of the channels; and detecting a cross-fading length on the basis of the overall similarity.

10. The audio signal expanding/compressing method according to claim 9, further comprising the step of adjusting the amplitude of the audio signal of each channel, wherein the similarity calculation step includes calculating the similarity of the audio signal between two successive intervals for each channel on the basis of the audio signal subjected to the amplitude adjustment step.

11. The audio signal expanding/compressing method according to claim 9, further comprising:

adjusting the similarity of each channel, wherein the calculating the overall similarity and the detecting the cross-fading length are performed on the basis of the adjusted similarity of each channel.

12. The audio signal expanding/compressing method according to claim 9, wherein:

the calculating the similarity for each channel includes determining the similarity of the audio signal between two successive intervals on the basis of a mean square error of the signal of the two intervals, and the detecting the cross-fading length includes determining the cross-fading length such that a smallest value of the sum of the mean square errors of the respective channels is obtained for the determined cross-fading length.

13. The audio signal expanding/compressing method according to claim 9, wherein:

the calculating the similarity for each channel includes determining the similarity of the audio signal between two successive intervals on the basis of a sum of absolute values of differences of the signal between the two intervals, and the detecting the cross-fading length includes determining the cross-fading length such that a smallest value of the sum of the sums of absolute values of differences of the respective channels is obtained for the determined cross-fading length.

14. The audio signal expanding/compressing method according to claim 9, wherein:

the calculating the similarity for each channel includes determining the similarity of the audio signal between two successive intervals on the basis of a correlation coefficient between the signals of the two intervals, and the detecting the cross-fading length includes determining the cross-fading length such that a greatest value of the sum of the correlation coefficients of the respective channels is obtained for the determined cross-fading length.

15. The audio signal expanding/compressing method according to claim 9, wherein the cross-fading length corresponds to two successive intervals in the audio signal selected from those for which a correlation coefficient is equal to or greater than a threshold value at least for one of channels.

16. The audio signal expanding/compressing method according to claim 9, further comprising:

determining whether or not a correlation coefficient of the audio signal between two successive intervals is equal to or greater than a threshold value for a channel having greatest energy, and, if not, discarding the two successive intervals as a candidate for determining the cross-fading length.

17. An audio signal expanding/compressing apparatus adapted to expand or compress, in a time domain, a plurality of channels of audio signals by using similar waveforms, comprising:

a cross-fading length detection unit adapted to detect a cross-fading length of the audio signals, the cross-fading length detection units:

calculating by a computer, for each channel, a similarity of the audio signal between two successive intervals having a same length as a function of the length calculating an overall similarity based on a sum of the similarities of the channels; and detecting the cross-fading length on the basis of the overall similarity.

* * * * *